US012180974B2

(12) United States Patent
Kahan et al.

(10) Patent No.: US 12,180,974 B2
(45) Date of Patent: Dec. 31, 2024

(54) VARIABLE INLET GUIDE VANE APPARATUS AND COMPRESSOR INCLUDING SAME

(71) Applicant: Copeland LP, Sidney, OH (US)

(72) Inventors: Cody N. Kahan, Marysville, OH (US); Cyril A. Duffala, Washington Township, OH (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 17/656,260

(22) Filed: Mar. 24, 2022

(65) Prior Publication Data

US 2023/0304508 A1 Sep. 28, 2023

(51) Int. Cl.

| | |
|---|---|
| ***F04D 29/46*** | (2006.01) |
| ***F04D 17/10*** | (2006.01) |
| ***F04D 29/056*** | (2006.01) |
| ***F04D 29/063*** | (2006.01) |
| ***F04D 29/42*** | (2006.01) |
| ***F04D 29/62*** | (2006.01) |

(52) U.S. Cl.
CPC ..... *F04D 29/462* (2013.01); *F04D 17/10* (2013.01); *F04D 29/056* (2013.01); *F04D 29/063* (2013.01); *F04D 29/4206* (2013.01); *F04D 29/624* (2013.01)

(58) Field of Classification Search
CPC .... F04D 29/462; F04D 29/056; F04D 29/063; F04D 29/4206; F04D 29/642; F04D 17/10; F04D 29/4213; F05D 2250/51; F05D 2260/53; F05D 2260/532; F01D 17/162
See application file for complete search history.

(56) References Cited

U.S. PATENT DOCUMENTS

| | | | | |
|---|---|---|---|---|
| 2,083,186 A * | 6/1937 | Anderson | F04D 29/462 415/160 |
| 2,733,853 A * | 2/1956 | Trumpler | F04D 29/462 416/186 A |
| 3,243,159 A * | 3/1966 | Hefler | F04D 29/462 415/150 |
| 4,150,915 A * | 4/1979 | Karstensen | F01D 17/162 251/286 |

(Continued)

FOREIGN PATENT DOCUMENTS

| | | | |
|---|---|---|---|
| CN | 201090533 Y | 7/2008 | |
| CN | 201265558 Y * | 7/2009 | F04D 29/4213 |

(Continued)

OTHER PUBLICATIONS

Espacenet Translation of CN 201265558 Y (Year: 2012).*
Translation of WO 2012161283 (Year: 2012).*

*Primary Examiner* — Juan G Flores
*Assistant Examiner* — Ryan C Clark
(74) *Attorney, Agent, or Firm* — Armstrong Teasdale LLP

(57) ABSTRACT

A variable inlet guide vane apparatus for imparting a motion to a fluid flow entering into a compressor. The variable inlet guide vane apparatus includes a housing defining a fluid flow passageway. The housing includes a first and second housing portion, a ring gear, and a plurality of guide vanes. The guide vanes include a stem, a gear, and a vane. The stem is disposed between the first and second housing portions, the vane is arranged within the fluid flow passageway, and the gears are arranged exterior the housing.

18 Claims, 19 Drawing Sheets

(56) References Cited

U.S. PATENT DOCUMENTS

| | | | | |
|---|---|---|---|---|
| 4,239,450 | A | 12/1980 | Geitner et al. | |
| 4,514,141 | A | 4/1985 | Marey | |
| 4,725,196 | A | 2/1988 | Kaneki et al. | |
| 6,039,534 | A | 3/2000 | Stoner et al. | |
| 6,860,725 | B2 | 3/2005 | Park et al. | |
| 6,994,518 | B2 | 2/2006 | Simon et al. | |
| 7,181,928 | B2 | 2/2007 | de Larminat | |
| 7,439,702 | B2 | 10/2008 | Smith et al. | |
| 8,079,808 | B2 | 12/2011 | Sconfietti | |
| 8,156,757 | B2 | 4/2012 | Doty et al. | |
| 9,200,640 | B2 | 12/2015 | Patil | |
| 10,227,931 | B2 | 3/2019 | Stockwell | |
| 10,233,941 | B2 | 3/2019 | Jan et al. | |
| 10,240,612 | B2 | 3/2019 | Yang et al. | |
| 10,364,826 | B2 | 7/2019 | Sishtla | |
| 10,458,430 | B2 | 10/2019 | Nakaniwa et al. | |
| 10,544,791 | B2 | 1/2020 | De | |
| 10,711,797 | B2 | 7/2020 | Kroger et al. | |
| 2007/0154302 | A1 | 7/2007 | Sconfietti | |
| 2010/0329898 | A1* | 12/2010 | Dunn | F04D 29/563 415/151 |
| 2012/0121403 | A1* | 5/2012 | Clemons | F04D 27/0246 415/208.1 |
| 2012/0134784 | A1* | 5/2012 | Yen | F04D 29/4213 415/151 |
| 2012/0171020 | A1* | 7/2012 | Peck | F04D 29/462 415/150 |
| 2013/0330177 | A1 | 12/2013 | Silveira et al. | |
| 2015/0125274 | A1* | 5/2015 | Liang | F04D 29/4213 415/157 |
| 2015/0322965 | A1* | 11/2015 | Hasegawa | F04D 29/462 415/150 |
| 2015/0330404 | A1* | 11/2015 | Sarri | F04D 29/441 415/203 |
| 2016/0281736 | A1 | 9/2016 | Wiederien et al. | |
| 2017/0167501 | A1 | 6/2017 | Saito et al. | |
| 2019/0178255 | A1* | 6/2019 | Leighty | F04D 27/002 |
| 2019/0285072 | A1 | 9/2019 | Masutani et al. | |
| 2020/0120881 | A1* | 4/2020 | Hall | F04D 29/464 |

FOREIGN PATENT DOCUMENTS

| | | | | |
|---|---|---|---|---|
| CN | 102478026 | A | 5/2012 | |
| CN | 202690536 | U | 1/2013 | |
| CN | 104564833 | A | 4/2015 | |
| DE | 29917625 | U1 | 3/2000 | |
| EP | 3499043 | A1 | 6/2019 | |
| GB | 2168432 | A | 6/1986 | |
| JP | 2012246767 | A | 12/2012 | |
| WO | 2011056167 | A1 | 5/2011 | |
| WO | WO-2012161283 | A1 * | 11/2012 | F01D 17/162 |
| WO | 2014067455 | A1 | 5/2014 | |
| WO | 2014077310 | A1 | 5/2014 | |
| WO | 2015031058 | A1 | 3/2015 | |

* cited by examiner

VARIABLE INLET GUIDE VANE APPARATUS AND COMPRESSOR INCLUDING SAME

FIELD OF THE DISCLOSURE

The field of the disclosure relates generally to compressors, and more particularly, to variable inlet guide vane apparatuses for use with compressors.

BACKGROUND

Inlet guide vane devices can be used to regulate pressure and direction of fluid flow at the inlet of a compressor, such as a centrifugal compressor. Conventional inlet guide vane devices include a plurality of guide vanes arranged circumferentially about a fluid flow path. The plurality of vanes impart a swirling motion to the fluid flow directing the fluid flow at suitable angles entering the compressor to improve efficiency and performance. The plurality of guide vanes may be rotated to adjust the orientation of the guide vanes relative to the fluid flow path to meet air intake requirements of the compressor for various operating conditions.

Each of the plurality of guide vanes may be rotatable relative to a housing mounted in proximity to the inlet of the compressor. High wear components of known inlet guide vane devices may be difficult to access for inspection and/or maintenance. Known inlet guide vane devices have one or more bearings which require maintenance, such as relubrication and/or periodic replacement, requiring downtime of the compressor. In some instances, the guide vane housing must be disconnected from the compressor, and then the guide vane housing disassembled during repair or inspection to access the guide vanes. The disassembly process can result in significant downtime of the compressor. Additionally, disassembly of the housing to access the guide vanes increases the likelihood of handling and installation damage, reducing the overall life of the inlet guide vane device. For example, disassembly of the housing may expose bearing surfaces to contaminates and debris potentially leading to etching and corrosion. Reassembling of the plurality of guide vanes relative to the housing may also result in misalignment.

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect an inlet guide vane apparatus includes a housing assembly defining a fluid flow passageway. The housing assembly includes a first housing portion and a second housing portion connected to and positioned axially upstream of the first housing portion. The first and second housing portions cooperatively define a plurality of guide vane openings extending radially through the housing assembly and into the fluid flow passageway. A ring gear is rotatable relative to the housing assembly. A plurality of guide vanes is connected to the housing assembly. Each of the guide vanes includes a stem extending from a first end to a second end. At least a portion of the stem is disposed within one of the guide vane openings. A vane gear is disposed at the first end of the stem and operably connected to the ring gear. The vane gear is disposed at an exterior of the housing assembly and a vane is disposed at the second end of the stem and within the fluid flow passageway of the housing assembly. Each of the guide vanes is rotatable relative to the housing assembly such that an orientation of the vane within the fluid flow passageway is selectively adjustable.

In another aspect, a compressor includes a compressor housing including an inlet and a driveshaft rotatably supported within the compressor housing. The compressor further includes an impeller connected to the driveshaft and operable to impart kinetic energy to incoming refrigerant gas upon rotation of the driveshaft. An inlet guide vane apparatus is connected to the compressor inlet. The inlet guide vane apparatus includes a housing assembly defining a fluid flow passageway. The housing assembly includes a first housing portion and a second housing portion connected to and positioned axially upstream of the first housing portion. The first and second housing portions cooperatively define a plurality of guide vane openings extending radially through the housing assembly and into the fluid flow passageway. A ring gear is rotatable relative to the housing assembly and a plurality of guide vanes is connected to housing assembly. Each of the guide vanes includes a vane gear operably connected to the ring gear and disposed at an exterior of the housing assembly and a vane disposed within the fluid flow passageway of the housing assembly. Each of the guide vanes is rotatable relative to the housing assembly such that an orientation of the vane within the fluid flow passageway is selectively adjustable.

In yet another aspect, a method of assembling an inlet guide vane apparatus including a housing assembly and a plurality of guide vanes is provided. The housing assembly includes a first housing portion and a second housing portion. Each of the guide vanes includes a stem extending from a first end to a second end. A vane gear is disposed at the first end of the stem and a vane disposed at the second end of the stem. The method includes rotatably connecting a ring gear to the first housing portion and connecting the first housing portion to the second housing portion such that the second housing portion is positioned axially upstream of the first housing portion, such that the first and second housing portions cooperatively define a plurality of guide vane openings extending radially through the housing assembly. The method further includes positioning the plurality of guide vanes relative to the second housing portion such that, when the first housing portion is connected to the second housing portion, at least a portion of the stem of each guide vane is disposed within one of the guide vane openings and the vane gear of each guide vane is positioned at an exterior of the housing assembly. The method includes operably connecting the vane gear of each guide vane to the ring gear.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
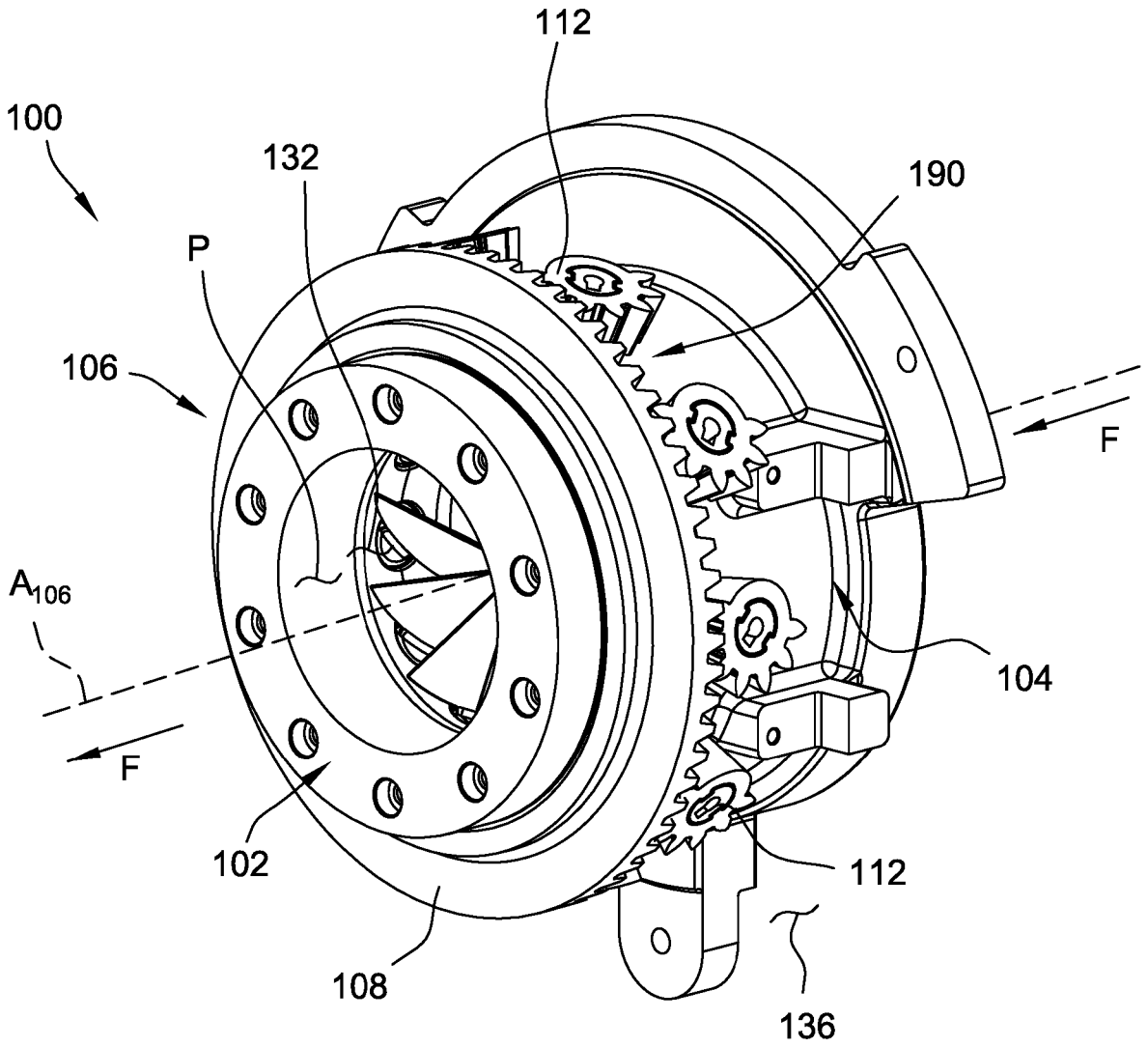
FIG. 1 is a perspective view of an example a variable inlet guide vane apparatus including a first and second housing portion, a bearing, a ring gear, and a plurality of guide vanes.

FIG. 1 is a perspective view of an example variable inlet guide vane apparatus, generally indicated at 100. The variable inlet guide vane apparatus 100 (also referred to herein as the inlet guide 100) is suitable for use with compressors, such as centrifugal compressors (see, e.g., compressor 300, shown in FIGS. 19 and 20), and can improve the operating range and efficiency of the compressor by imparting a pre-swirl motion to a fluid flow F entering the compressor. The inlet guide 100 may be mounted in proximity to an inlet of the compressor and the fluid flow F exits the inlet guide 100 with a pre-swirl and enters into the inlet of the compressor, such that the fluid flow F contacts an impeller of the compressor with a suitable direction. Alternatively, and/or additionally, the inlet guide vane 100 is mounted in proximity to the inlet for each stage of a multi-stage compressor.

Figure 2:
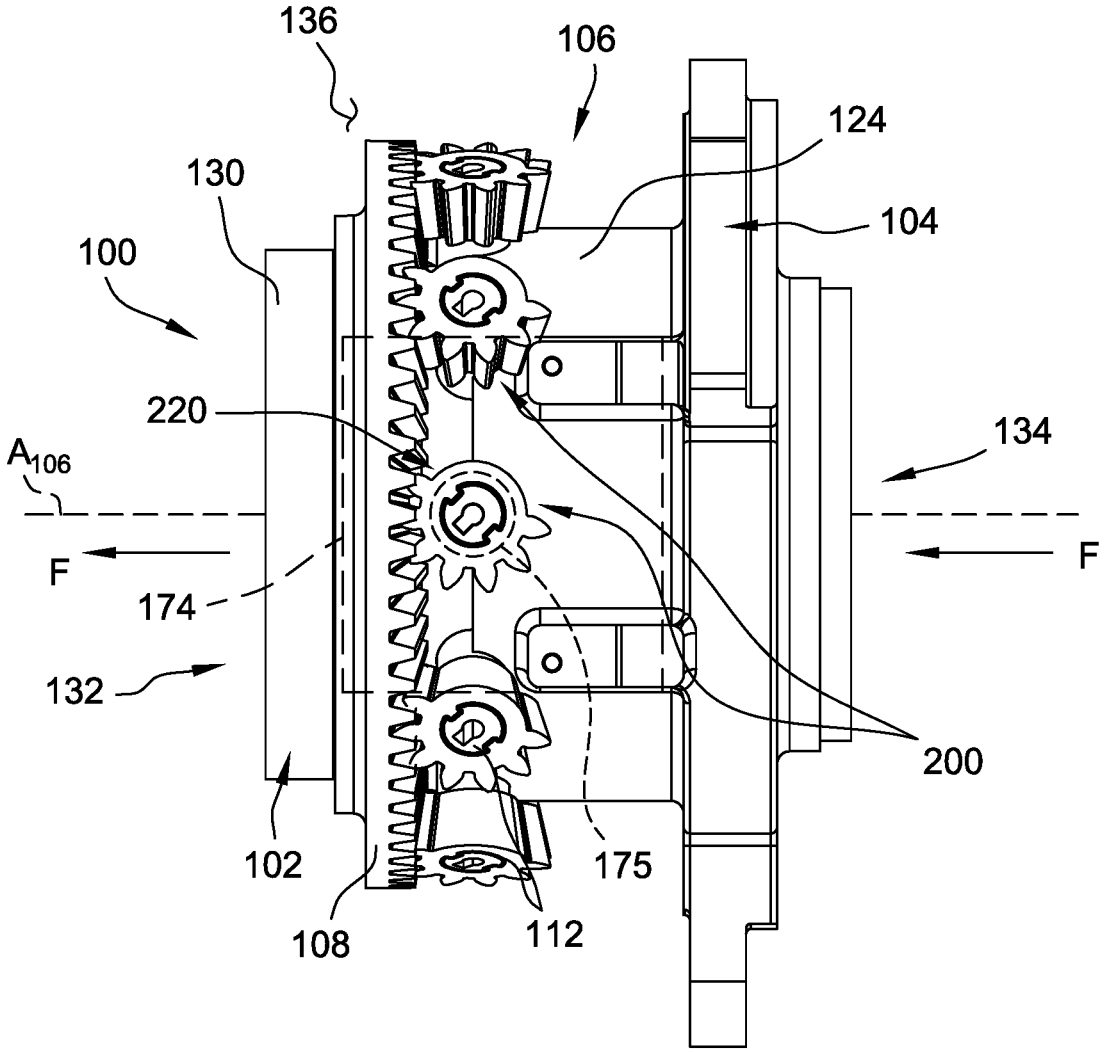
FIG. 2 is a side view of the variable inlet guide vane apparatus shown in FIG. 1.
Figure 3:
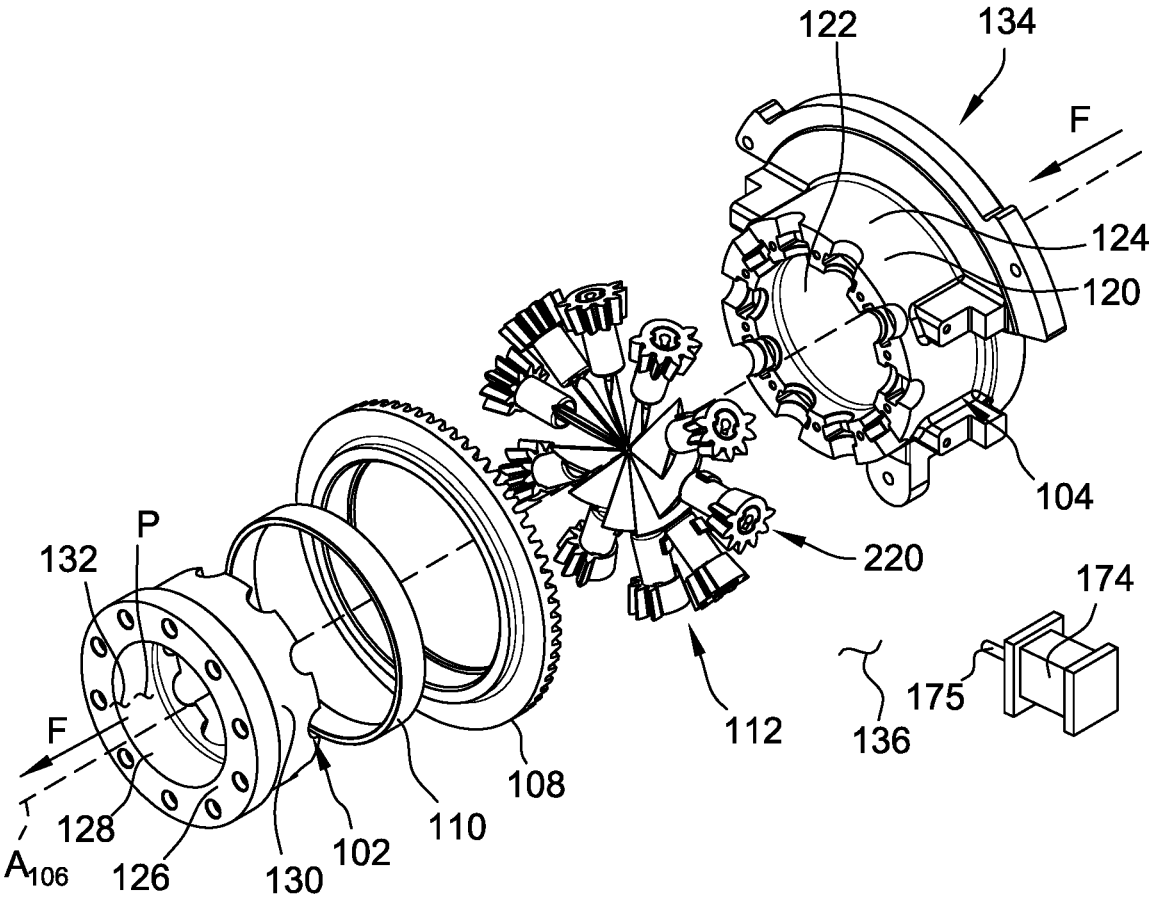
FIG. 3 is an exploded view of the variable inlet guide vane apparatus shown in FIG. 1.

FIG. 2 is a side view of the inlet guide 100, and FIG. 3 is an exploded view of the inlet guide 100. In the illustrated embodiment, the inlet guide 100 includes a first housing portion 102 and a second housing portion 104. The first housing portion 102 and the second housing portion 104 can be connected to form a vane housing assembly 106. The second housing portion 104 is positioned axially upstream from the first housing portion 102 relative to the direction of fluid flow. The inlet guide 100 also includes a ring gear 108 rotatably connected to the housing assembly 106. In the illustrated embodiment, the ring gear 108 is rotatably connected to the first housing portion 102. The ring gear 108 can be rotatably connected to the housing assembly 106 by a bearing, such as bearing 110 (FIG. 3). In other embodiments, the bearing 110 may be omitted.

Inlet guide 100 further includes a plurality of a guide vanes 112. Each guide vane 112 is rotatable relative to the vane housing assembly 106 and is operably connected with the ring gear 108 such that rotation of the ring gear 108 causes each of the plurality of guide vanes 112 to rotate in unison. Each of the guide vanes 112 is rotatable relative to the housing assembly 106 such that the orientation of the vane 160 within a fluid flow passageway P of the housing assembly 106 is selectively adjustable. In some embodiments, the guide vanes 112 are rotatable relative to the housing assembly 106 in unison The inlet guide 100 can also include one or more motors 174 operably connected to one or more of the guide vanes 112 to selectively rotate the guide vanes 112. The illustrated inlet guide 100 includes a motor 174 mounted to a motor mount on the second housing portion 104. The motor 174 is operably coupled to one of the guide vanes 112, also referred to as a drive guide vane, by a driveshaft 175. As described further herein, rotation of the drive guide vane by the motor 174 causes rotation of the ring gear 108, which in turn causes rotation of the other guide vanes 112, also referred to as follower guide vanes. The motor 174 can include any suitable motor that enables the inlet guide 100 to function as described herein, including, for example and without limitation, electric motors. In some embodiments, the motor 174 is a stepper motor. In other embodiments, the motor 174 includes a synchronous motor that operates based on rotation feedback from one or more of the follower vanes, e.g., using a potentiometer or position sensor coupled to one or more of the follower vanes, to ensure all vanes are driven to the desired angle. The motor 174 may include for example and without limitation a DC motor, brushed or brushless, and a synchronous AC motor.

With additional reference to FIG. 3, the first housing portion 102 includes a first annular wall 126 having a first inner surface 128 and a first outer surface 130. The second housing portion 104 includes a second annular wall 120 having a second inner surface 122 and a second outer surface 124. The first inner surface 128 and the second inner surface 122 defines the boundary of a fluid flow passageway P extending through the vane housing assembly 106. The vane housing assembly 106 has a housing axis $A_{106}$ extending through the fluid flow passageway P. The first housing portion 102 defines an exit or outlet 132 of fluid flow passageway P, and the second housing portion 104 defines an inlet 134 of the fluid flow passageway P. The fluid flow F enters the vane housing assembly 106 at the inlet 134, passes through the fluid flow passageway P, and leaves the vane housing assembly 106 at the outlet 132. The fluid flow F flows through the fluid flow passageway P in a direction that is generally parallel to the housing axis $A_{106}$. Fluid flow F leaving the exit 132 has a pre-swirl imparted by the plurality of the guide vanes 112, as described in further detail herein.

The vane housing assembly 106 includes an exterior area 136 surrounding the first outer surface 130 and the second outer surface 124 and located generally radially outward from the housing assembly 106. In the illustrated embodiment, at least a portion of each of the plurality of guide vanes 112 is disposed between the first housing portion 102 and second housing portion 104, and at least a portion of the guide vane 112 and the ring gear 108 is arranged in the exterior area 136 of the vane housing assembly 106. Accordingly, the ring gear 108 and at least a portion of the guide vane 112 are accessible (e.g., to an operator or technician) for inspection and/or repairs without requiring inlet guide 100 to be disassembled. By way of example, an operator or technician can access the ring gear 108 and a portion of the guide vanes 112 (e.g., vane gears, described in more herein) without first disconnecting the first housing portion 102 from the second housing portion 104.

Figure 4:
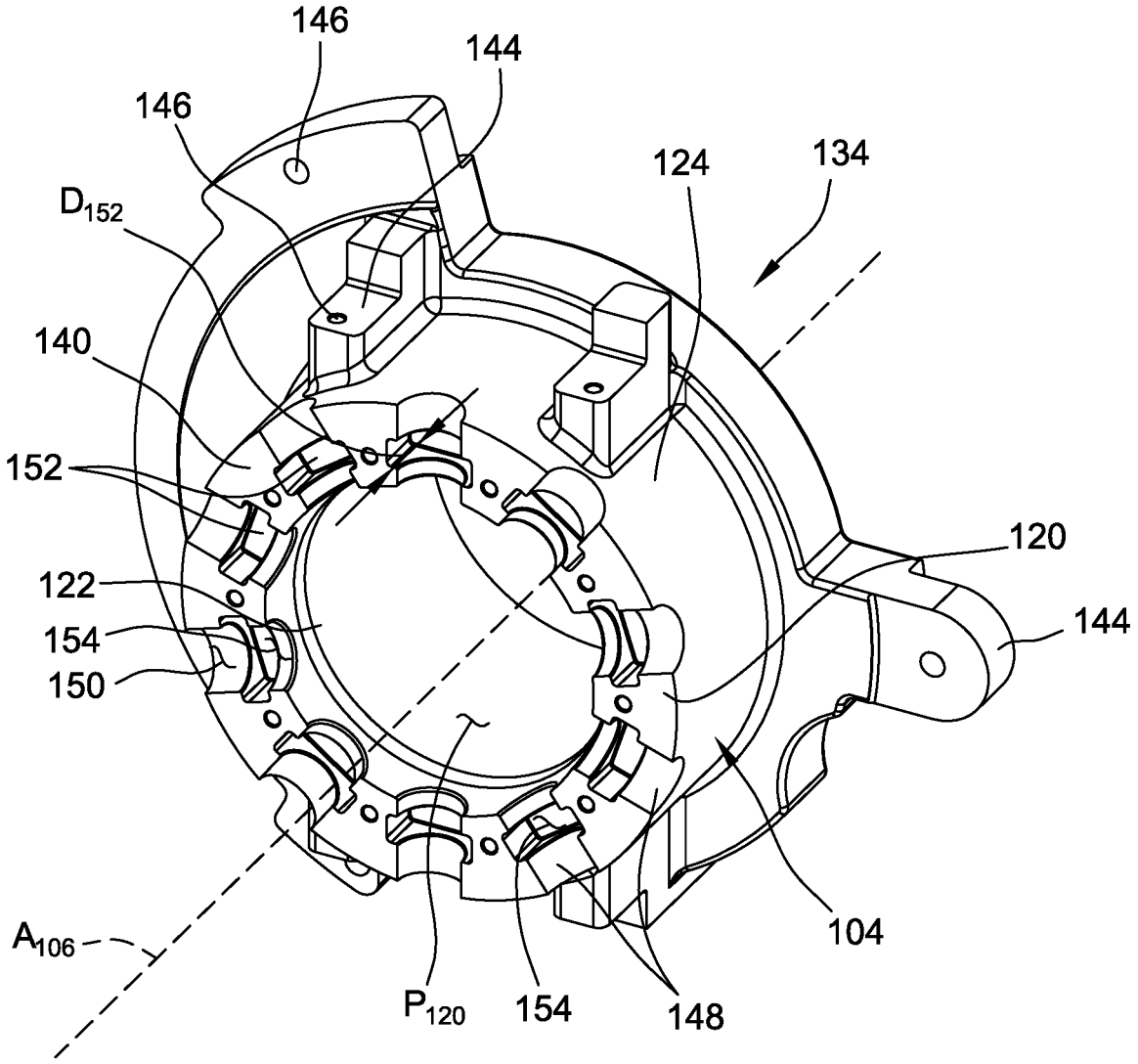
FIG. 4 is a perspective view of the second housing portion for use with the variable inlet guide vane apparatus shown in FIG. 1.
Figure 5:
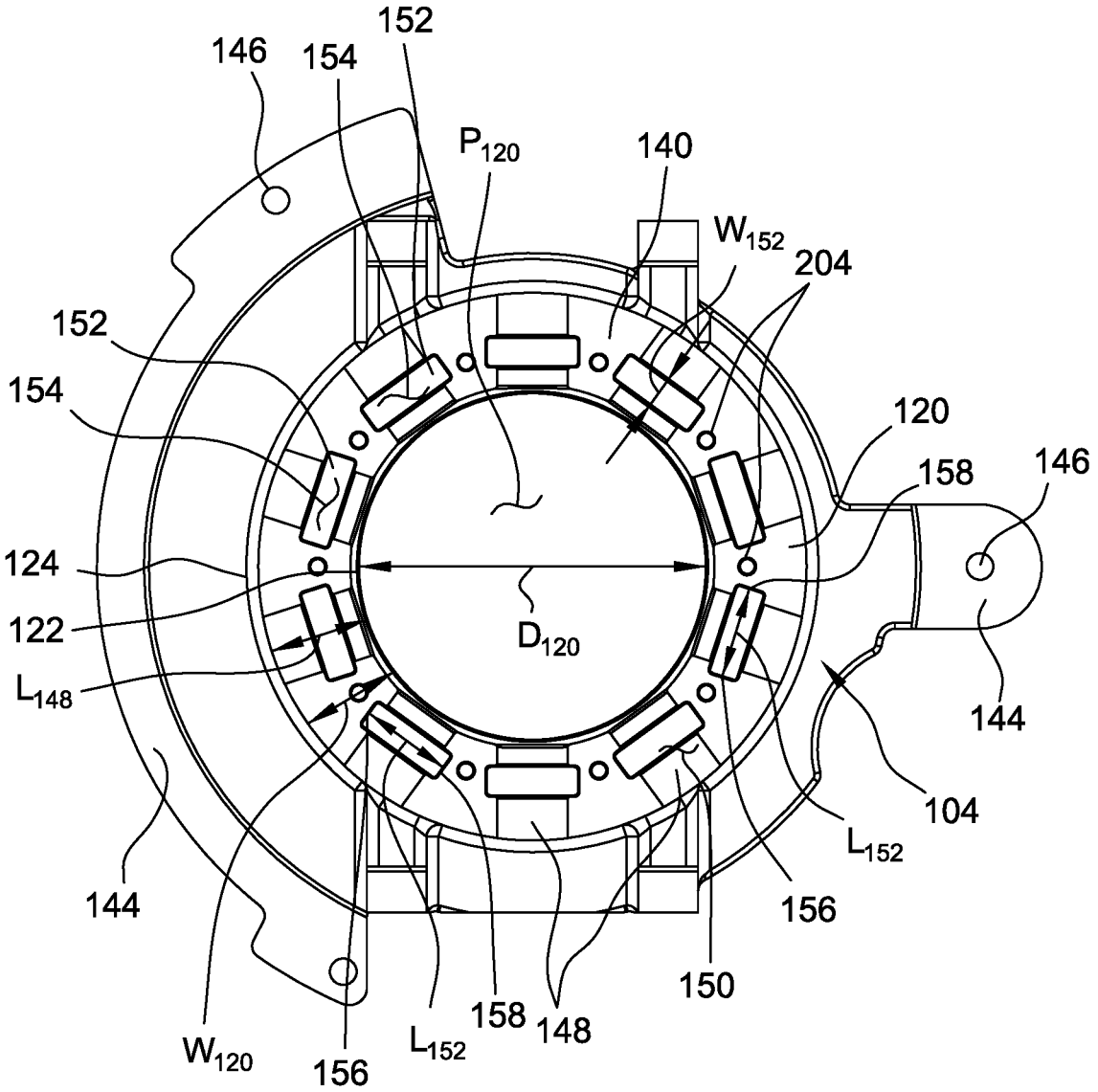
FIG. 5 is a rear or downstream view of the second housing portion shown in FIG. 4.
Figure 6:
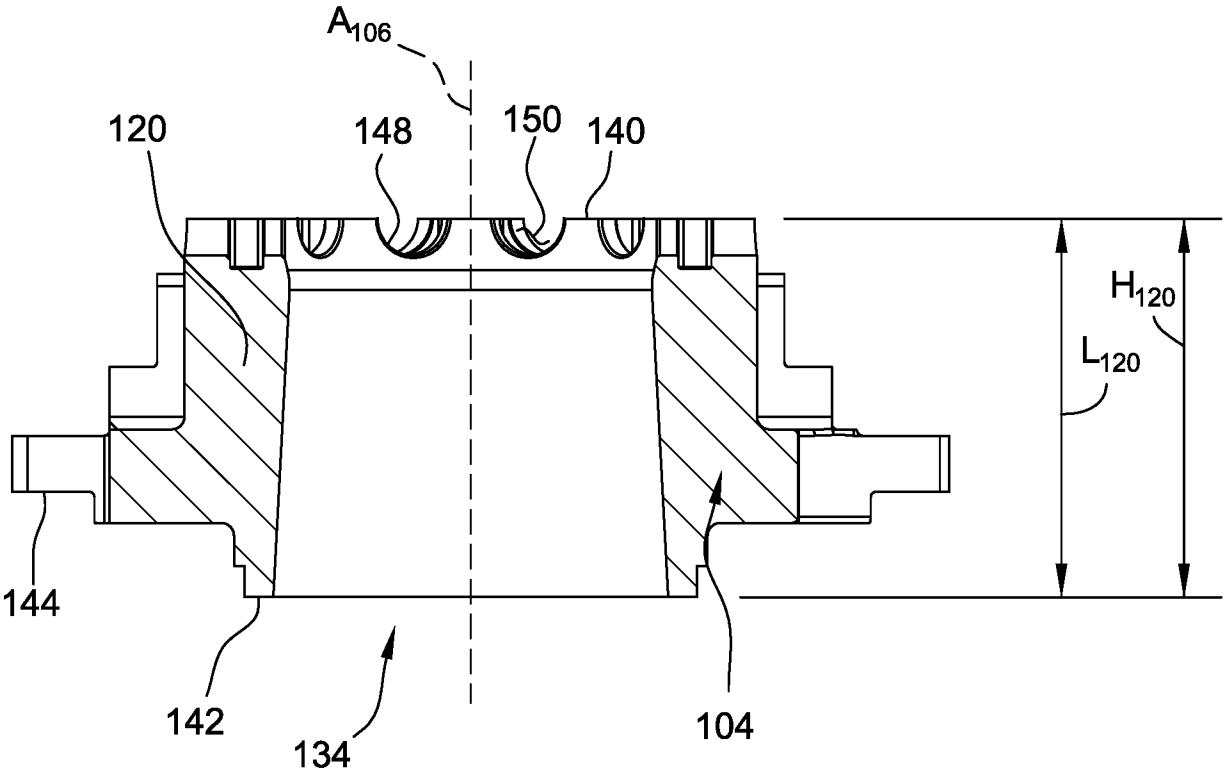
FIG. 6 is a sectional view of the second housing portion shown in FIG. 4.

FIG. 4 is a perspective view of the second housing portion 104. FIGS. 5 and 6 are a rear view and a sectional view, respectively, of the second housing portion 104. The second annular wall 120 includes a downstream surface 140 and an upstream surface 142. The downstream surface 140 is generally annular in shape. The second annular wall 120 may have a width $W_{120}$ extending between the second outer surface 124 and the second inner surface 122. (FIG. 5). The second annular wall 120 may have a height $H_{120}$ extending between the downstream surface 140 and the upstream surface 142. (FIG. 6). The second inner surface 122 defines the boundary of a second fluid flow passageway $P_{120}$ that includes a diameter $D_{120}$ defined by the second inner surface 122. In the illustrated embodiment, the second fluid flow passageway $P_{120}$ is generally conical in shape and the diameter $D_{120}$ decreases in a direction from the inlet 134 to the outlet 132 along the axis $A_{106}$. In other embodiments, the second fluid flow passageway $P_{120}$ can be generally cylindrical in shape and the diameter $D_{120}$ defined by the second inner surface 122 is generally constant. The second fluid flow passageway $P_{120}$ has a length $L_{120}$. In the illustrated embodiment, the length $L_{120}$ corresponds to the height $H_{120}$ of the second annular wall 120. The housing axis $A_{106}$ extends through the second fluid flow passageway $P_{120}$. The upstream surface 142 is generally planar and may be mounted to a compressor. Alternatively, the second housing portion 104 may be mounted to any suitable structure in proximity to the inlet of a compressor. The dimensions of the compressor, e.g., width $W_{120}$, height $H_{120}$, diameter $D_{120}$, and length $L_{120}$, may be scaled to the size of the compressor and the aerodynamic needs of the compressor.

With reference to FIGS. 4-6, the second housing portion 104 includes one or more flanges 144 extending radially outward from the second annular wall 120. The flange 144 may extend generally perpendicular to the second annular wall 120. The flanges 144 include one or more fastener openings 146 for receiving suitable fasteners (e.g., screws, bolts, etc.) to connect the second housing portion 104 to a compressor.

With reference again to FIG. 5, the downstream surface 140 includes a plurality of second channel surfaces 148, each defining a corresponding second channel 150. Each of the plurality of second channel surfaces 148 are arranged in a radially symmetric pattern about the housing axis $A_{106}$. In the illustrated embodiment, the downstream surface 140 of the second annular wall 120 includes ten second channel surfaces 148 defining ten second channels 150 arranged in a radially symmetric pattern about the housing axis $A_{106}$. In alternative embodiments, the downstream surface 140 may include any number of second channels surfaces 148 that enables the inlet guide 100 to function as described herein. For example, in some embodiments, there are six second channel surfaces 148 defining six second channels 150.

In the illustrated embodiment, each of the plurality of second channel surfaces 148 are identical, having the same size and shape. In the illustrated embodiment, the second channel surfaces 148 are in the shape of a segment of a cylindrical surface. Accordingly, the second channels 150 are generally in the shape of a half-cylinder. The second channel surface 148 has a second channel length $L_{148}$ extending from the second inner surface 122 to the second outer surface 124. In the illustrated embodiment, the second channel surfaces 148 and second channels 150 extend through the entire width $W_{120}$ of the second annular wall 120. In other embodiments, the second channel surfaces 148 extend only partially through the width $W_{120}$ of the second annular wall 120. The second channel surfaces 148 are sized and shaped such that second channels 150 are sized and shaped to receive at least a portion of the guide vanes 112 therein, as described in further detail herein.

In the illustrated embodiment, each second channel surface 148 includes a secondary channel surface 152 defining a slot 154. The secondary channel surface 152 extends radially from the second channel surface 148, such that the slot 154 has a depth $D_{152}$ extending from the second channel surface 148 (FIG. 4). The secondary channel surface 152 defining the slot 154 includes a first end 156 and a second end 158, and a secondary channel length $L_{152}$ extending therebetween (FIG. 5). The secondary channel surface further defines a slot width $W_{152}$.

Figure 7:
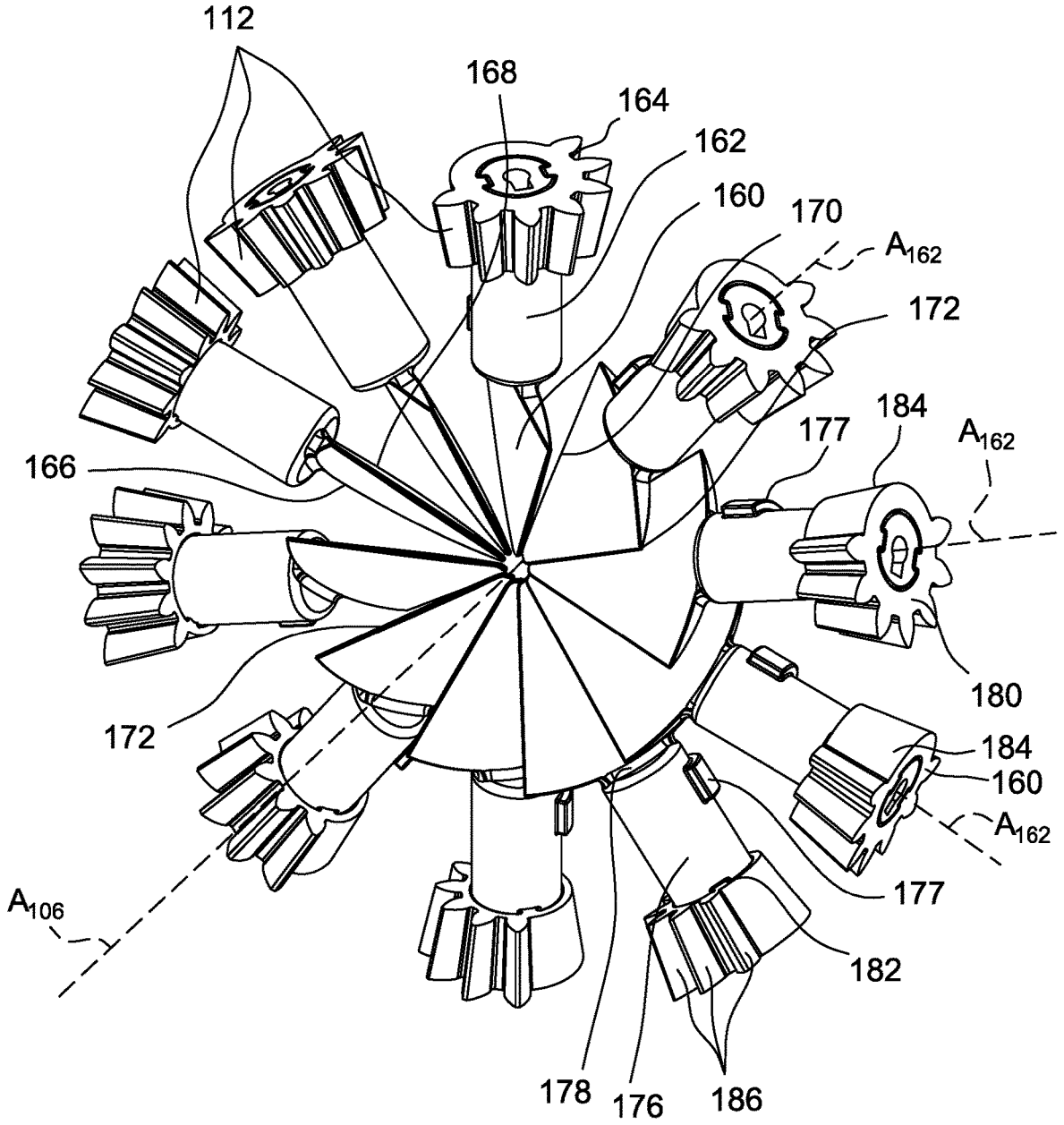
FIG. 7 is a perspective view of the plurality of guide vanes for use with the variable inlet guide vane apparatus shown in FIG. 1.

FIG. 7 is a perspective view of the plurality of guide vanes 112. Each of the plurality of guide vanes 112 includes a vane 160, a stem 162, and a vane gear 164. The plurality of guide vanes 112 are arranged in a radially symmetric pattern mirroring the radially symmetric pattern of the plurality of second channel surfaces 148 on the second housing portion 104. In the illustrated embodiment, there are ten guide vanes 112 corresponding to the ten second channels surfaces 148. In other embodiments, the inlet guide 100 can include any suitable number of guide vanes 112 that enables the inlet guide 100 to function as described herein. For example, in some embodiments there may be six guide vanes 112 corresponding to six second channel surfaces 148.

In the illustrated embodiment, the vane 160 is formed integrally with the stem 162. For example, the vane 160 and the stem 162 may be molded as a single piece. In alternative embodiments, the vane 160 may be formed separately from and connected to the stem 162. The vane 160 is substantially triangular, in the illustrated embodiment, and includes a first vane side 166 and an opposing second vane side 168. The first and second vane sides 166, 168 are substantially planar. The first and second vane sides 166 and 168 connect at a trailing edge 170 and a leading edge 172. The trailing and leading edges 170 and 172 may be knife-like in shape. The plurality of vanes 160 are selectively rotatable to selectively occlude or block, fluid flow F through the fluid flow passageway $P_{120}$. The plurality of vanes 160 may be prevented from being rotated to arrange the vanes 160 in a closed position, in which the trailing edge 170 of each guide vane is in contact with, or in close proximity with, the leading edge 172 of an adjacent guide vane, as described herein.

The first and second housing portions 102 and 104 cooperatively define a plurality of guide vane passages $P_{160}$. Each of the plurality of vanes 160 may cover one of the vane passages $P_{160}$. Each vane passage $P_{160}$ is a portion of the fluid flow passageway P. The vane passages $P_{160}$ are spaced circumferentially about the fluid flow passageway P. The vane 160 is any shape or size enabling the inlet guide 100 to function as describe herein. Additionally, the shape and size of the vane 160 may be selected based upon the intended application of the inlet guide 100. For example, the size, shape, and angle of the vane 160 may be selected based on the type and configuration of the compressor, the operating conditions, and/or the fluid type used with the compressor. Each of the guide vanes 112 is rotatable relative to the vane housing assembly 106 such that the orientation of the vane 160 within the fluid flow passageway P is selectively adjustable.

Figure 8:
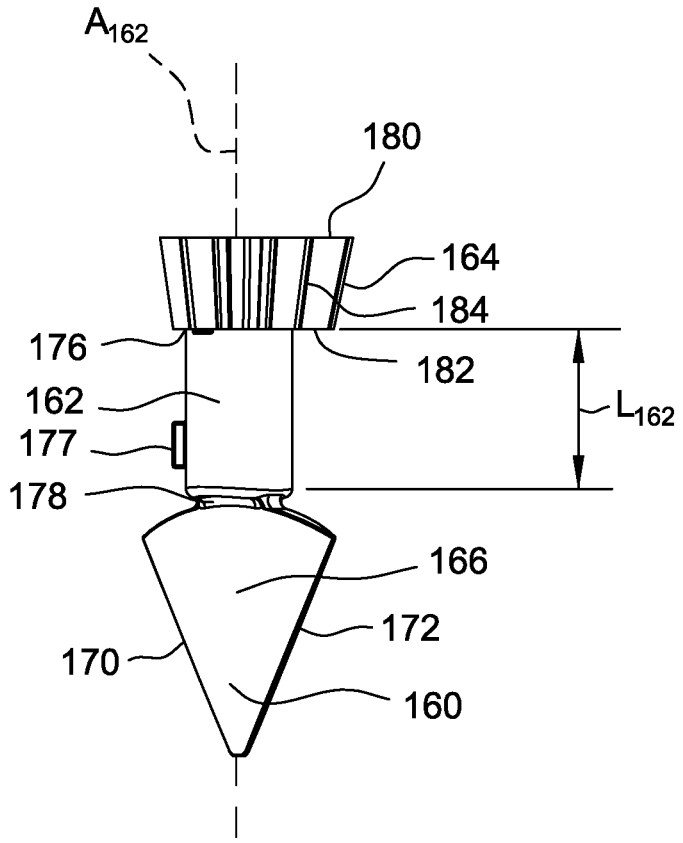
FIG. 8 is a side view of one of the plurality of guide vanes shown in FIG. 7.
Figure 9:
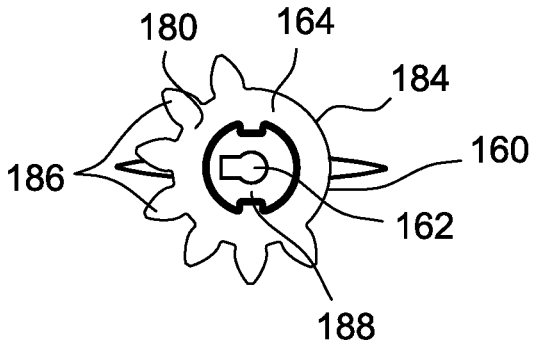
FIG. 9 is a top view of the guide vane shown in FIG. 8.

FIGS. 8 and 9 are side and top views, respectively, of one of the guide vanes 112 shown in FIG. 7. The stem 162 extends along a stem axis $A_{162}$ from a first, inner end 178 to a second, outer end 176. The vane 160 is disposed at the first, inner end 178 of the stem 162, and the vane gear 164 is disposed at the second, outer end 176 of the stem 162. The stem 162 has a stem length $L_{162}$ between the inner end 178 and the outer end 176. The stem length $L_{162}$ may be substantially similar to the second channel length $L_{148}$. When the stem 162 is arranged within one of the plurality of second channels 150, the stem axis $A_{162}$ is perpendicular to the housing axis $A_{160}$.

In this illustrated embodiment, the guide vane 112 includes a stop 177 extending circumferentially about the stem 162, and radially outward in a direction generally perpendicular to the stem axis $A_{106}$, from the stem 162. The stop 177 is sized and shaped to fit within the slot 154 defined by the secondary channel surface 152. In the illustrated embodiment, the stop 177 is generally rectangular in shape. The stop 177 and the secondary channel surface 152 are sized and shaped such that the stop 177 slides along the length $L_{152}$ relative to the secondary channel surface 152 when the guide vane 112 rotates relative to the first housing portion 102 and the second housing portion 104 about the stem axis $A_{162}$. In addition, the slot width $W_{152}$ is sized and shaped such that the stop 177 contacts the secondary channel surface 152, preventing the guide vane 112 from translating along a direction parallel to the stem axis $A_{162}$. The slot width $W_{152}$ is sized to provide sufficient clearance between the stop 177 and the secondary channel surface 152 such that the stop 177 may translate along the slot length $L_{152}$.

The stop 177 extends only partially around the circumference of the stem 162. In the illustrated embodiment, the stop 177 extends circumferentially an arc angle of about 45° around the circumference of the stem 162. In other embodiments, the stop 177 may extend an arc angle greater than or less than 45°. For example, in some embodiments, the stop 177 may extend an arc angle of 90° around the stem 162. In another example, the stop 177 may extend an arc angle of 30° around the stem 162.

The stop 177 limits rotation of the guide vane 112 about the stem axis $A_{162}$ when the stop 177 engages with a stop surface of at least one of the first housing portion 102 or the second housing portion 104, as described further herein.

The vane gear 164 includes a top surface 180, a bottom surface 182, and a wall 184 extending between the top surface 180 and the bottom surface 182. The wall 184 is generally cylindrical in shape (FIG. 8). The vane gear 164 includes a plurality of gear teeth 186 extending radially outward from the wall 184. In some embodiments, such as the illustrated embodiment, the vane gear 164 is a tapered gear—i.e., the gear teeth 186 are tapered or angled radially inward or outward from the top surface 180 to the bottom surface 182. In some embodiments, the vane gear 164 may be a bevel gear. In some embodiments, the vane gear 164 may be a helical gear.

In the illustrated embodiment, the vane gear 164 is a partial gear in which the gear teeth 186 extend around only a portion of the wall 184. In the illustrated embodiment, the gear teeth 186 extend an arc angle of approximately 225° around the wall 184. In other embodiments, the gear teeth 186 may extend around the wall 184 an ac angle of greater than or less than 225°. Further, in the illustrated embodiment, the gear teeth 186 are positioned generally opposite the stop 177 on the stem 162. Accordingly, during operation, the vane gear 164 is arranged to engage with the ring gear 108, while the stop 177 is captured within the slot 154.

Figure 10:
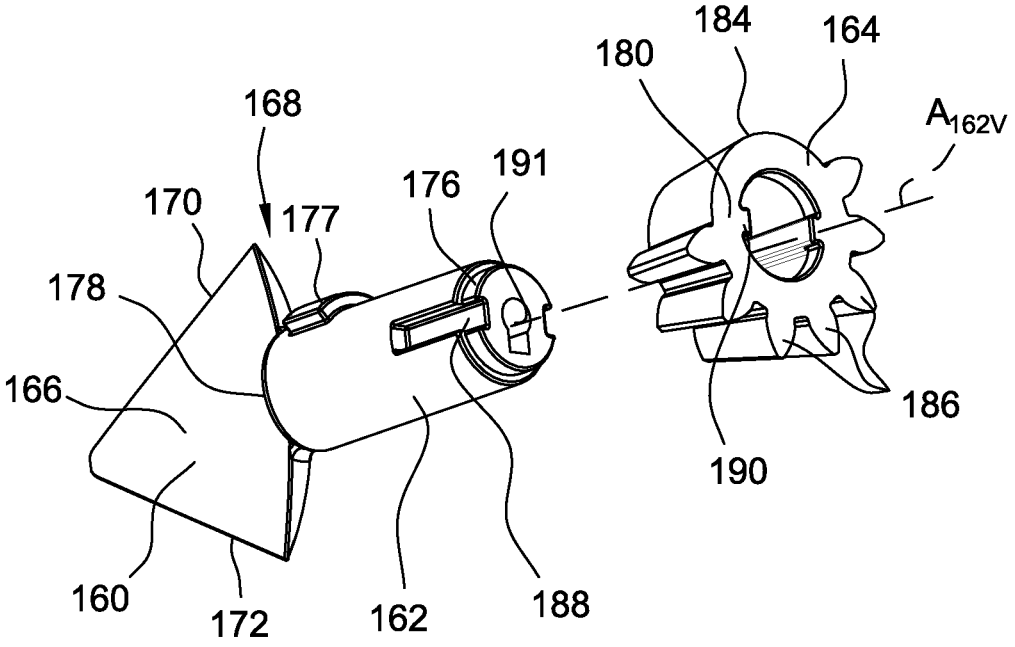
FIG. 10 is an exploded view of the guide vane shown in FIG. 8.

FIG. 10 is an exploded view of the guide vane 112. In some embodiments, the vane gear 164 is removably connected to the stem 162 of the guide vane 112. In the illustrated embodiment, for example, the outer end 176 of the stem 162 is received within a central opening of the vane gear 164 to connect the vane gear 164 to the stem 162. In some embodiments, the stem 162 and the vane gear 164 may be connected using a press-fit engagement when the outer end 176 is disposed within the central opening of the vane gear 164. Additionally, and/or alternatively, an epoxy, or other suitable adhesive, may be used to connect the stem 162 and the vane gear 164. Additionally, in the illustrated embodiment, the stem 162 includes a key 188 disposed at the outer end 176 and the vane gear 164 includes a keyed boundary 190 defining a keyed opening 189 sized and shaped to receive the key 188. When the key 188 is disposed within the keyed opening 189, the stem 162 and the vane gear 164 are frictionally engaged and rotation of the vane gear 164 is transmitted to the stem 162. In some embodiments, the key 188 may be press fit within the keyed opening 189. In some embodiments, the key 188 may include a channel, and the boundary 190 may include a key that is sized and shaped to fit within the channel. Alternatively, and/or additionally, the key 188 and the boundary 190 may include any suitable features that enable frictional engagement of the vane gear 164 and the stem 162. In other embodiments, the vane gear 164 is integral with the guide vane (e.g., the vane gear 164 is formed integrally with the stem 162).

In the illustrated embodiment, the guide vane 112 includes an alignment feature 191. The alignment feature 191 receives a portion of the driveshaft of a motor, such as driveshaft 175 of motor 174, enabling the guide vane 112 to be operably connected to the motor. Accordingly, the alignment feature 191 is shaped complimentary to the driveshaft. For example, the alignment feature 191 may be keyed, semicircular, or star shaped, or any suitable shape such that the alignment feature 191 mates with the driveshaft in order to frictionally couple the driveshaft to the alignment feature 191. Alternatively, and/or additionally, the alignment feature 191 may be sized and shaped to receive an alignment tool (not shown) to facilitate alignment and mounting of the guide vanes 112 to the vane housing assembly 106.

Figure 11:
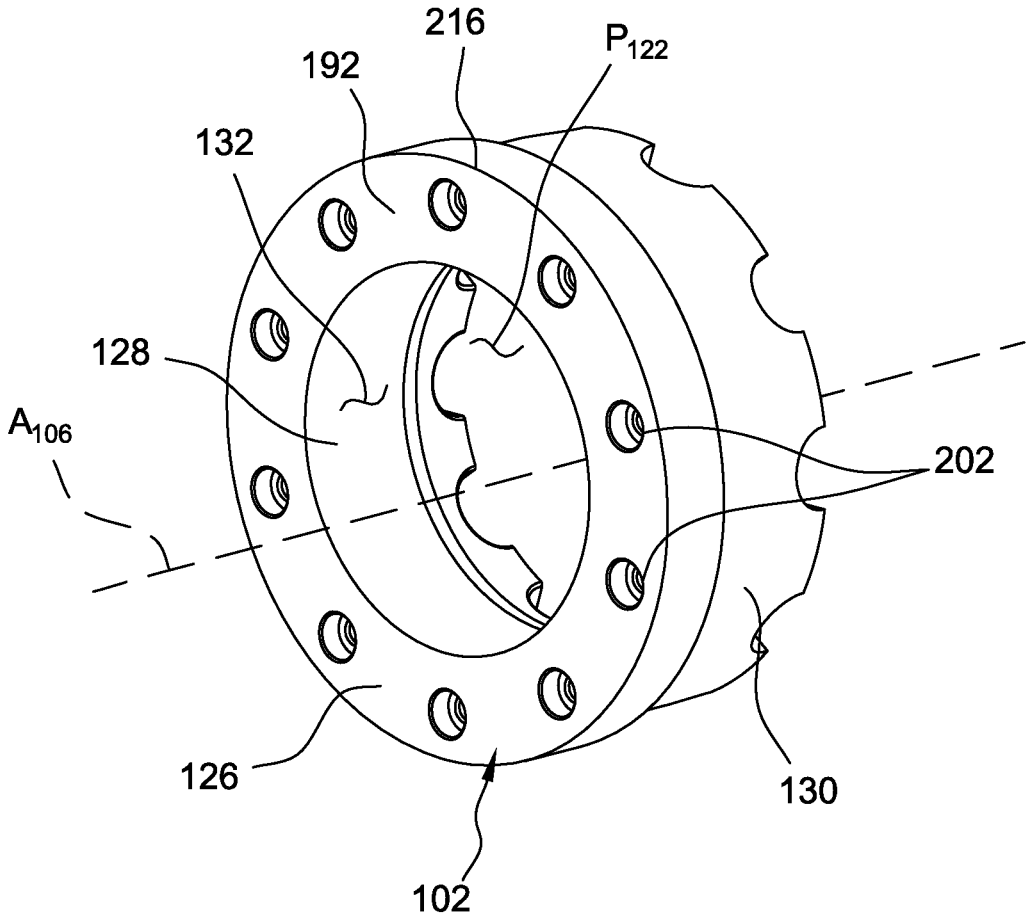
FIG. 11 is a perspective view of the first housing portion for use with the variable inlet guide vane apparatus shown in FIG. 1.
Figure 12:
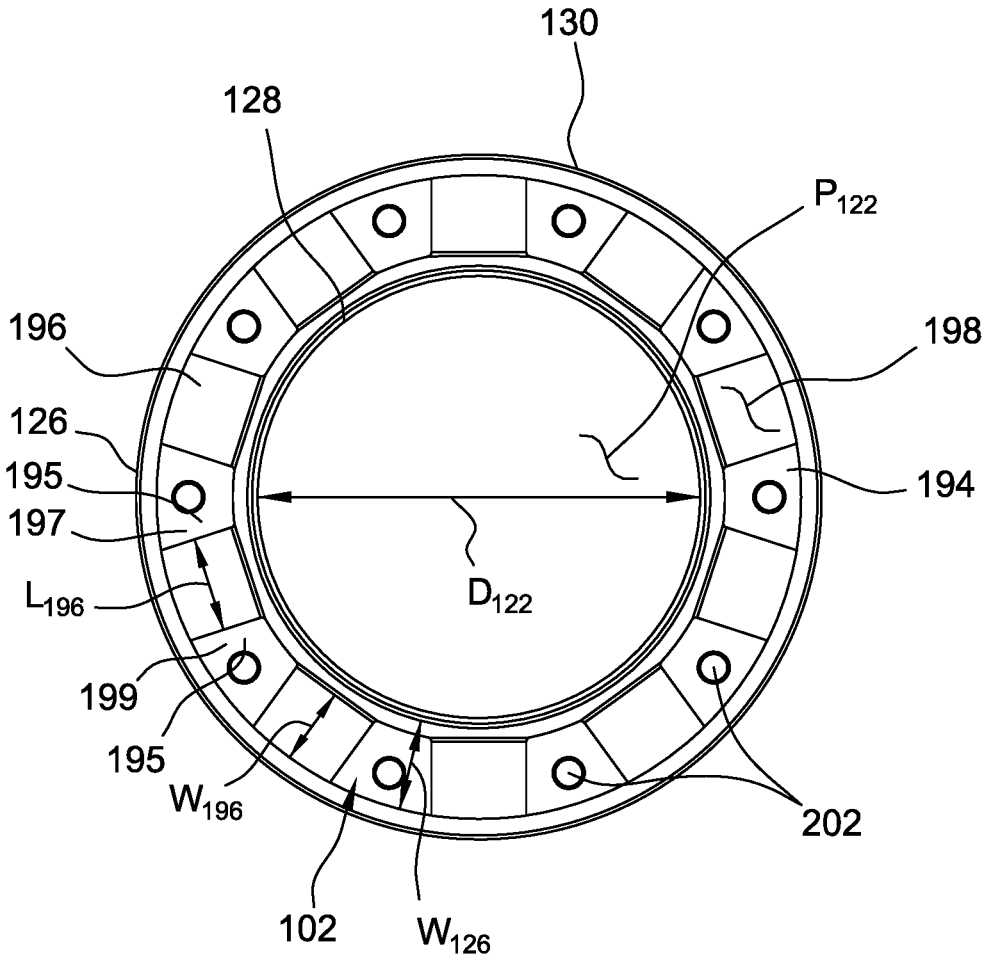
FIG. 12 is a front or upstream view of the first housing portion shown in FIG. 11.
Figure 13:
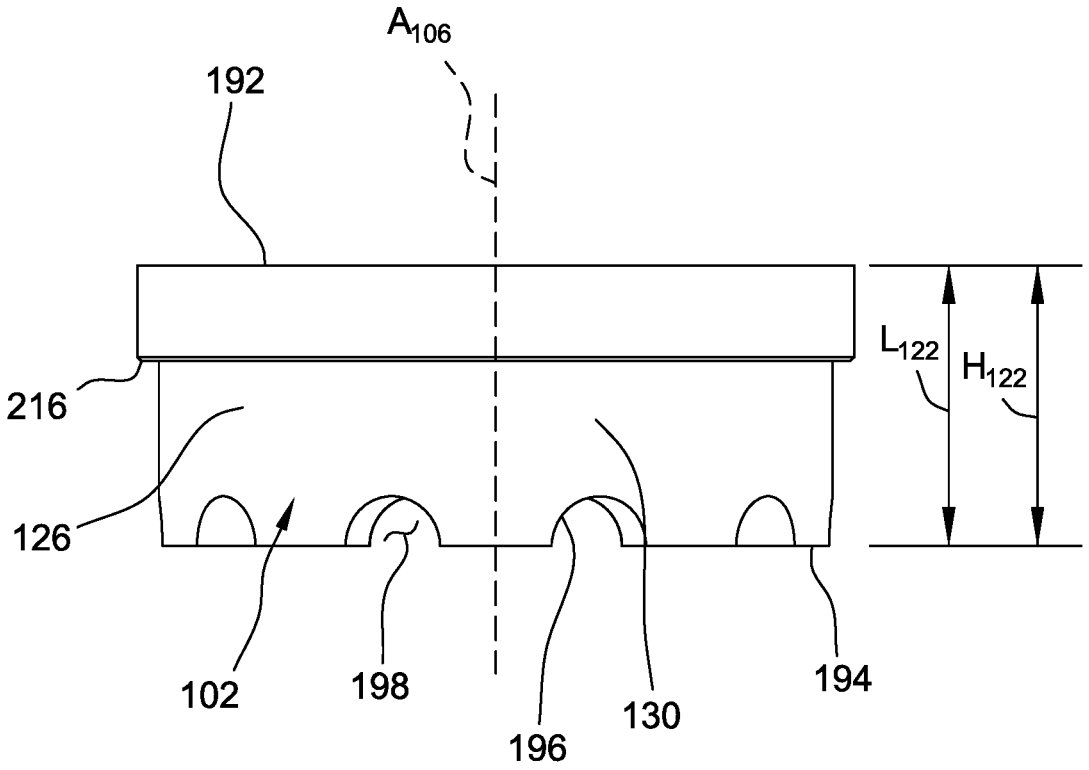
FIG. 13 is a side view of the first housing portion shown in FIG. 11.

FIG. 11 is a perspective view of the first housing portion 102. The first annular wall 126 includes a downstream surface 192 and an upstream surface 194. The upstream surface 194 is generally annular in shape. The first annular wall 126 has a width $W_{126}$ extending between the first outer surface 130 and the first inner surface 128. (FIG. 12). The first annular wall 126 may have a height $H_{126}$ of extending between the downstream surface 192 and the upstream surface 194 (FIG. 13). The first inner surface 128 defines the boundary of a first fluid flow passageway $P_{122}$. The first fluid flow passageway $P_{122}$ is generally cylindrical in shape having a diameter $D_{122}$ defined by the first inner surface 128. In the illustrated embodiment, the diameter $D_{122}$ is substantially similar to the diameter $D_{120}$ of the second inner surface 122. (FIG. 12) The first fluid flow passageway $P_{122}$ has a length $L_{122}$ corresponding the height $H_{122}$ of the first annular wall 126 (FIG. 13). The housing axis $A_{160}$ extends through the first fluid flow passageway $P_{122}$. When the first housing portion 102 and the second housing portion 104 are connected, creating the vane housing assembly 106, the first fluid flow passageway $P_{120}$ and the second fluid flow passageway $P_{122}$ are aligned creating the fluid flow passageway P. The dimensions of the compressor, e.g., width $W_{126}$, height $H_{126}$, diameter $D_{122}$, and length $L_{122}$, may scaled to the size of the compressor and/or the aerodynamic needs of the compressor.

FIG. 12 is a front view of the first housing portion 102. The upstream surface 194 of the first housing portion 102 includes a plurality of first channel surfaces 196 that define a plurality of first channels 198. The plurality of first channel surfaces 196 are arranged in a radially symmetric pattern, about the housing axis $A_{106}$ that mirrors the radially symmetric pattern of the second channel surfaces 148 and the radially symmetric pattern of the plurality of guide vanes 112. In the illustrated embodiment, each of the first channel surfaces 196 are substantially similar having approximately the same size and shape. In other example embodiments, the first channel surfaces 196 are identical to the second channel surfaces 148. Each of the first channel surfaces 196 includes a first channel length $L_{196}$ and a first channel width $W_{196}$ (FIG. 12). The first channel width $W_{196}$ may extend from the first inner surface 128 to the first outer surface 130.

In the illustrated embodiment, the first channel surfaces 196 are in the shape of a segment of a cylindrical surface. Accordingly, the first channels 198 are generally half-cylindrical in shape. In the illustrated embodiment, the first channel surface 196 extends along the entire width $W_{126}$ of the upstream surface 194. In other embodiments, the first channel surfaces 196 extend only partially along the width of the upstream surface 194.

As mentioned above, the stop 177 limits rotation of the guide vanes 112 about the stem axis $A_{162}$ when the stop 177 engages one or more stop surfaces 195. In the illustrated embodiment, for example, the first housing portion 102 includes a first stop surface 197 and a second stop surface 199 (FIG. 12). When the guide vane 112 rotates in a first direction (e.g., counterclockwise), the stop 177 slides within slot 154, until the stop 177 engages the first stop surface 197, preventing or inhibiting further rotation of the guide vane 112. When the guide vane 112 rotates in a second direction (e.g., clockwise), the stop 177 slides within slot 154, until the stop 177 engages the second stop surface 199, preventing or inhibiting further rotation of the guide vane 112.

In some embodiments, contact between the stop 177 and the stop surfaces 195 serves as a stop for a stepper motor. Specifically, in the illustrated embodiment, the stop 177 is disposed within the slot 154 and when the guide vane 112 rotates, the stop 177 travels along the slot length $L_{154}$. The guide vanes 112 may include a drive guide vane operably connected to a motor, and a plurality of follower guide vanes that rotate in response to rotation of the drive guide vane. In such embodiments, the stepper motor may rotate the drive guide vane 112 until the stop 177 on one of the guide vanes 112 engages with either the first stop surface 197 or the second stop surface 199, arresting the rotational motion of all of the guide vanes 112 and stopping the stepper motor.

In the illustrated embodiment, the slot 154, the stop 177, and the first stop surface 197 and the second stop surface 199 are configured to allow the motor to rotate the guide vanes 112 a total of 90°. For example, the plurality of guide vanes 112 are positionable in a first rotational position of 0°, or a neutral position, such that the first vane side 166 or the second vane side 168 of each guide vane 122 is arranged generally parallel to the housing axis $A_{106}$ and/or parallel to the fluid flow F entering the inlet 134. In the illustrated embodiment, when the guide vanes 112 are in the neutral position, the stop 177 is arranged in a center of the slot 154. The stop 177 and the stop surfaces 195 are arranged to allow the plurality of guide vanes 112 to be positionable between +450 and −450 degrees relative to the neutral position such that the first vane side 166 or the second vane side 168 may be arranged at a desired angle relative to the housing axis $A_{106}$ and the fluid flow F entering the inlet 134 depending on the desired operating condition.

In some embodiments, the second housing portion 104 can include one or more of the stop surfaces 195. For example, in some embodiments, the first end 156 and the second end 158 includes stop surfaces that interact with stop 177. In such embodiments, the guide vane 112 rotates, in either the first or second directions, until the stop 177 engages with the stop surfaces, preventing or inhibiting further rotation of the guide vane 112.

When the first housing portion 102 is connected to the second housing portion 104, each of the second channels 150 are aligned with each of the first channels 198, such that the first and second channels 198 and 150 cooperatively form a plurality of guide vane openings 200 extending radially through the vane housing assembly 106 (FIG. 2). The boundary of the guide vane openings 200 is defined by the first channel surface 196 and second channel surface 148. Each guide vane opening 200 is generally cylindrical and is sized and shaped to receive at least a portion of the stem 162 of one of the guide vanes 112 therein. The stem 162 of each guide vane 112 is rotatable relative to the first channel surface 196 and second channel surface 148 such that each guide vane 112 rotates within one of the guide vane openings 200 about its respective stem axis $A_{162}$. In some embodiments, the first channel surface 196 and the second channel surface 148 includes a plain bearing to facilitate rotation of the stem 162 relative to the first channel surface 196 and the second channel surface 148. Additionally, and/or alternatively, the stem 162 and the first channel surface 196 and second channel surface 148 may include suitable bearings enabling the inlet guide 100 to function as described herein. In some embodiments, the stem 162 and/or the first channel surface 196 and the second channel surface 148 may be impregnated with Teflon or other suitable lubricants. In the example embodiment, the inlet guide vane 100 may be used with an oil free compressor.

The first housing portion 102 and the second housing portion 104 may be connected in any suitable manner that enables the inlet guide 100 to function as described herein. In the illustrated embodiment, the first housing portion 102 is connected to the second housing portion 104 by a plurality of screws. More specifically, the first housing portion 102 includes a plurality of fastener openings 202 extending through the first annular wall 126, and the second housing portion 104 includes a plurality of fastener opening 204 corresponding to the arrangement of the plurality of openings 202 on the first housing portion 102. Each of the fastener openings 204 may include a threaded portion, such that a threaded bolt or screw (not shown) may be inserted through the opening 202 on the first housing portion 102 and threaded into the threaded portion of the openings 204 on the second housing portion 104. In other embodiments, the first housing portion 102 and second housing portion 104 may be connected using any suitable fasteners to connect the first housing portion 102 and second housing portion 104 together forming the vane housing assembly 106.

When the stem 162 of each guide vane 112 is arranged within one of the guide vane openings 200 of the vane housing assembly 106, the vane gears 164 are arranged in the exterior area 136 of the vane housing assembly 106, and each of the plurality of vanes 160 is arranged within the fluid flow passageway P. Accordingly, in the illustrated embodiment, each of the vane gears 164 are accessible to an operator for inspection and/or repair without needing to disconnect or disassemble the first housing portion 102 and the second housing portion 104. In embodiments in which the vane gear 164 is removably connected to the stem 162, the vane gear 164 can be readily replaced with another vane gear. For example, an operator may replace a worn or damaged vane gear 164 by disconnecting the vane gear 164 from the stem 162 and connecting a new or repaired vane gear 164 to the stem 162. As mentioned above, the vane gear 164 and the stem 162 may be formed of a single piece. Furthermore, disconnecting the first housing portion 102 from the second housing portion 104 provides access to all of the plurality of guide vanes 112, simultaneously.

Figure 14:
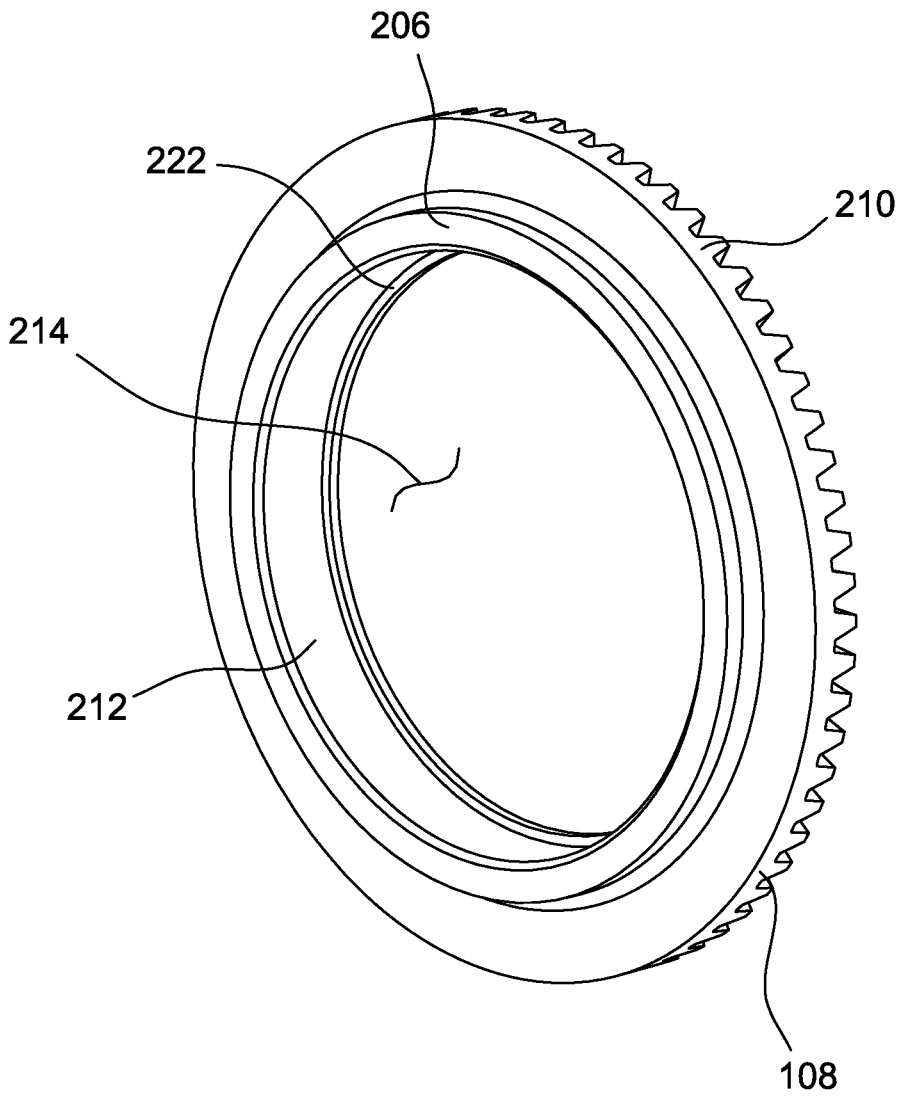
FIG. 14 is a perspective view of the ring gear for use with the variable inlet guide vane apparatus shown in FIG. 1.

FIG. 14 is a perspective view of the ring gear 108. The ring gear 108 includes a first surface 206, a ring second surface 208, and an annular wall 210 extending therebetween. The annular wall 210 includes a ring inner surface 212 defining the boundary of a ring opening 214. The inner surface 212 is sized and shaped such that at least a portion of the first housing portion 102 can be received within the ring opening 214. In the illustrated embodiment, the ring gear 108 is rotatably connected to and rotatable relative to the first housing portion 102. In other embodiments, the ring gear 108 is rotatably connected to the second housing portion 104.

The first housing portion 102 includes a lip 216 extending radially outward from the first outer surface 130 (FIG. 13). The lip 216 engages a surface 217 of the press fit bearing 110 when the bearing 110 is disposed around the first outer surface 130. The lip 216 engages the bearing 110 to prevent or inhibit axial translation of the bearing 110 relative to the first housing portion 102. Alternatively, when the ring gear 108 is rotatably connected to the first housing portion 102, the lip 216 may be in contact with the first surface 206 of the ring gear 108 to prevent or inhibit translation axially of the ring gear 108 relative to the first housing portion 102.

Figure 15:
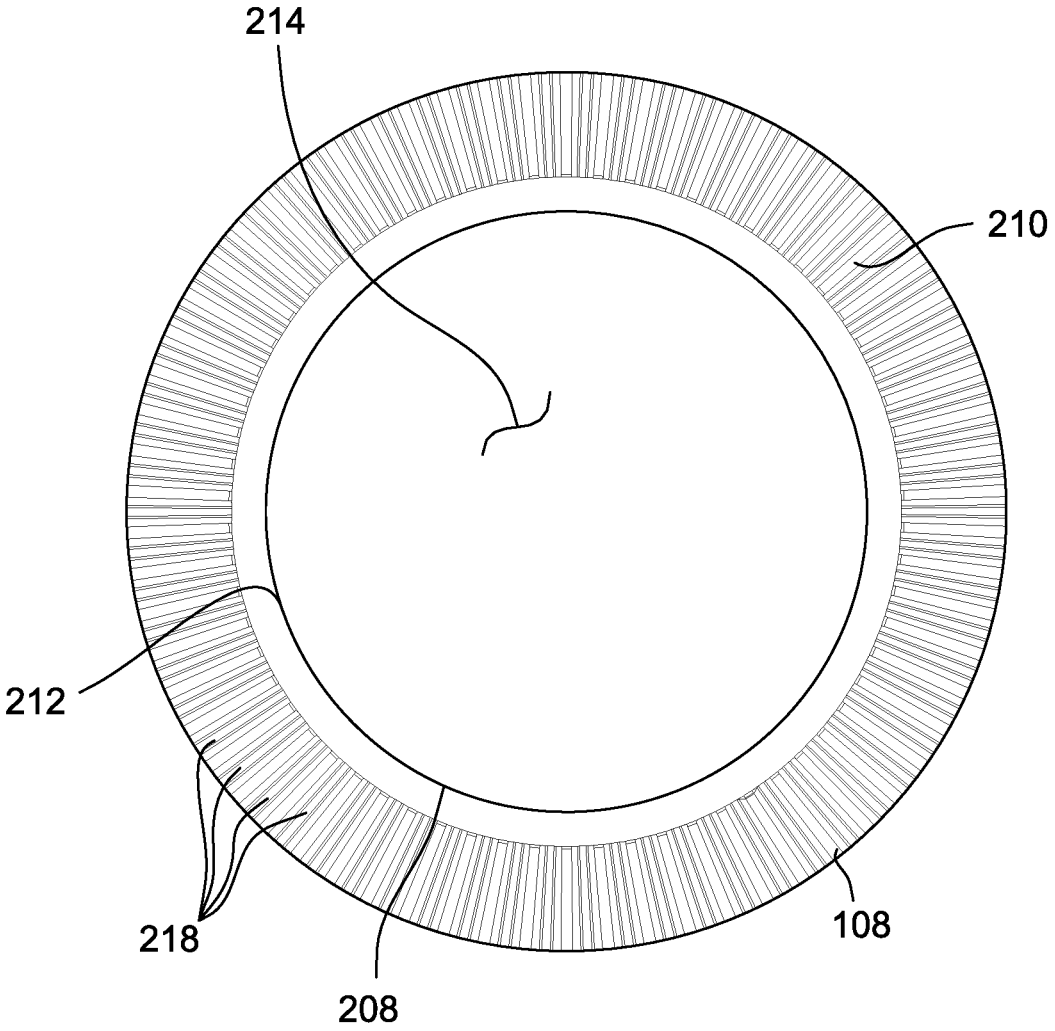
FIG. 15 is an end view of the ring gear shown in FIG. 14.
Figure 16:
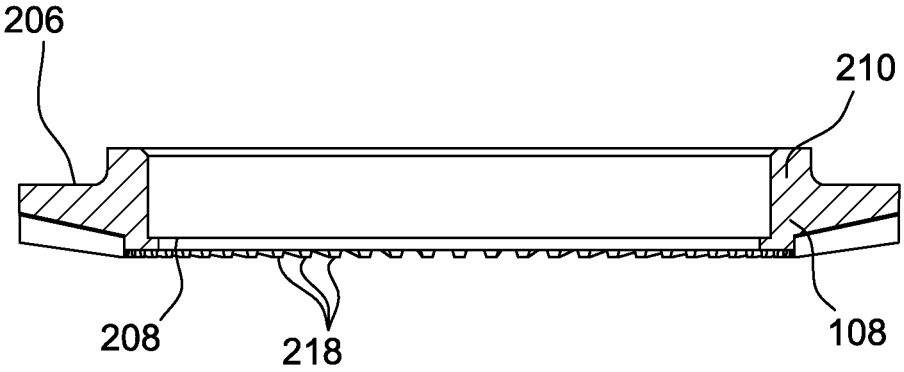
FIG. 16 is a sectional view of the ring gear shown in FIG. 14.

FIG. 15 is an end view of the ring gear 108 and FIG. 16 is a side view of the ring gear 108. The ring second surface 208 of the ring gear 108 includes a plurality of gear teeth 218. The gear teeth 218 of the ring gear 108 are sized and shaped to mate with the gear teeth 186 of each of the vane gears 164 of the guide vanes 112. Rotation of the ring gear 108, about the housing axis $A_{106}$, is transmitted to the vane gears 164, causing rotation of the guide vanes 112 about the vane axis $A_{162}$, within the guide vane openings 200 of the vane housing assembly 106. The ring gear 108 further includes a feature 222 disposed on the inner surface 212. The feature 222 engages with the bearing 110, preventing the bearing 110 from translating axially relative to the ring gear 108. The feature 222 may span about the circumference of the inner surface 212. In some example embodiments, the feature 222 includes a lip.

The ring gear 108, and the vane gears 164, are arranged in the exterior area 136 of the vane housing assembly 106 enabling an operator to inspect and/or repair the ring gear 108 without disconnecting the first housing portion 102 and second housing portion 104. The accessibility of the ring gear 108 and the vane gears 164 is beneficial in that it reduces the time required to inspect and/or repair the ring gear 108 and the vane gears 164. In addition, the accessibility of the vane gears 164 and the ring gear 108, without disassembling the first housing portion 102 and the second housing portion 104, helps prevent bearing surfaces between the first channel surface 196, the second channel surface 148, and the stem 162 from being exposed to debris and/or contaminates.

In the illustrated embodiment, at least one of the guide vanes 112 is a drive guide vane 220. The drive guide vane 220 is operably connected to motor 174 (e.g., by the driveshaft 175), and the motor drives rotation of the drive guide vane 220. Rotation of the drive guide vane 220 causes rotation of the ring gear 108, which transmits rotation to the rest of the plurality of guide vanes 112, referred to as follower guide vanes. Accordingly, all of the plurality of guide vanes 112 rotate in unison. In some embodiments, the motor is a stepper motor. In some embodiments, the motor is communicatively connected to a controller and the controller transmits one or more instructions to the motor causing the motor to rotate the drive guide vane 220 in order to arrange the plurality of guide vanes 112 in a selected orientation relative to the fluid flow F.

Figure 17:
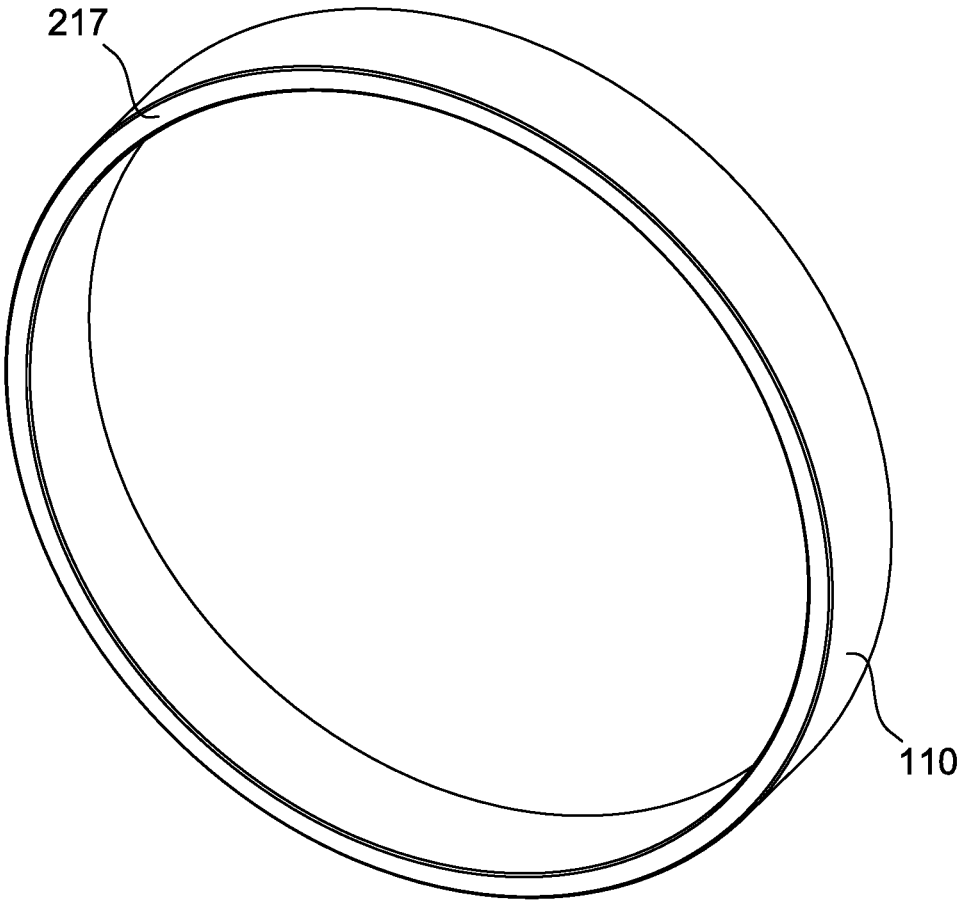
FIG. 17 is a perspective view of the bearing of the variable inlet guide vane apparatus shown in FIG. 1.

FIG. 17 is a perspective view of the bearing 110. The bearing 110 may be arranged between the first outer surface 130 of the first housing portion 102 and the ring inner surface 212 of the ring gear 108. The bearing 110 facilitates rotation of the ring gear 108 about the first housing portion 102. In some embodiments, the bearing 110 is connected to the ring gear 108, e.g., the bearing 110 is press fit into frictional engagement with the ring inner surface 212. Accordingly, the ring gear 108 and the bearing 110 rotate relative to the first housing portion 102. Alternatively, the bearing 110 may be press fit onto first housing portion 102 such that the bearing 110 and the first housing portion 102 are frictionally engaged and the ring gear 108 rotates relative to the bearing 110 and the first housing portion 102.

The bearing 110 may be a non-lubricating bearing or a self-lubricating bearing. As such, the bearing 110 does not require application of lubricants. In some embodiments, for example, the bearing 110 is constructed of bronze and/or bronze composite. In some embodiments, the bearing 110 is bronze coated. The bearing 110 may be impregnated with lubricants or the bearing 110 may include one or more graphite plugs. In alternative embodiments, the bearing 110 may include any suitable type of bearing 110 that enables the inlet guide 100 to function as described herein.

In alternative embodiments, the bearing 110 may be omitted and the ring gear 108 may rotate about the first housing portion 102, without the use of a bearing.

Figure 18:
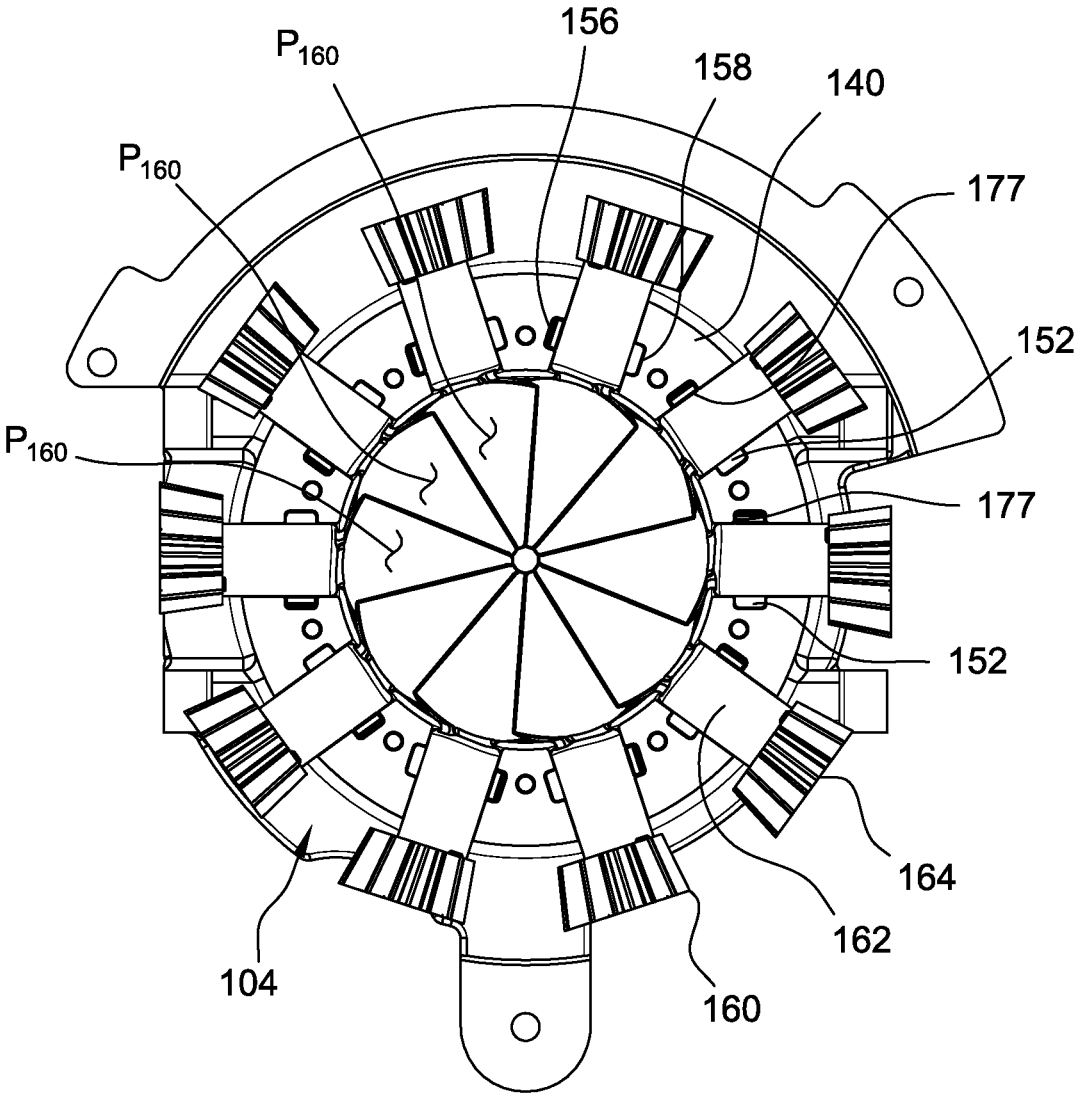
FIG. 18 is a rear or downstream view of the variable inlet guide vane apparatus having the first housing portion, ring gear, and bearing disconnected, illustrating the plurality of guide vanes arranged within a second channel on the second housing portion.

FIG. 18 is a rear view of the inlet guide 100, having the first housing portion 102, ring gear 108, and bearing 110 removed therefrom to illustrate the arrangement of the plurality of guide vanes 112 arranged within the plurality of second channels 150. As described above, simultaneous rotation of the plurality of the guide vanes 112 changes the orientations of the vanes 160 relative to fluid flow F entering the inlet 134. For example, the guide vanes 112 may be rotated, in unison, to arrange the inlet guide 100 to any suitable position based on the operational needs of the compressor. For example, the guide vanes 112 may be rotated, in unison, to arrange the inlet guide 100 to a fully open or neutral position. In the fully open position, the guide vanes 112 are arranged such that the first vane side 166 and the second vane side 168 of the vanes 160 are arranged generally parallel to the direction of the fluid flow F such that the vanes 160 do not substantially impede the fluid flow F through the fluid flow passageway P. In the fully open position, the vanes 160 align the fluid flow F creating a more laminar fluid flow F profile thereby increasing efficiency of the compressor. The plurality of guide vanes 112 may be rotated to arrange the vanes 160 in any suitable orientation relative to the fluid flow F and the fluid flow passageway P. For example, the motor may rotate the drive guide vane 220 in either a clockwise or a counterclockwise direction to adjust the orientation of the plurality of vanes 160. The position of the vanes 160 may be selected to increase the operating range of the compressor, including both surge and choke.

In some embodiments, sensors (not shown) may be attached to one or more of the guide vanes 112 to measure the rotational position of the guide vanes 112. The sensor may be communicatively coupled to the controller. The controller may use feedback received from the sensor to determine instructions for the motor. In some embodiments, one or more sensors may be used to measure the rotational speed of the guide vanes 112. For example, the guide vanes 112 may be rotated at a rotational speed of 1 rotation per min (rpm) or less.

Figure 19:
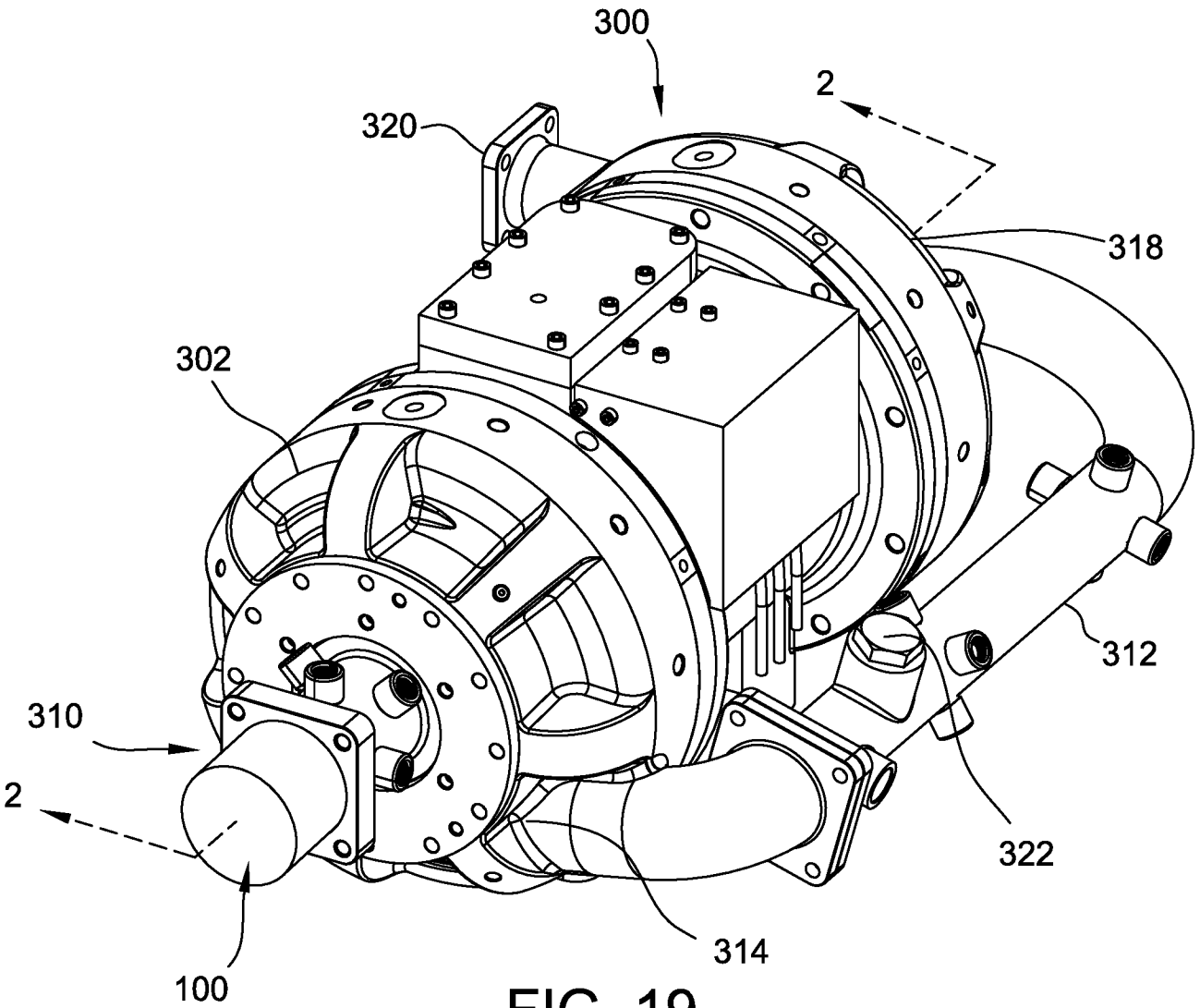
FIG. 19 is a perspective view of an assembled compressor for use with the variable inlet guide vane apparatus.
Figure 20:
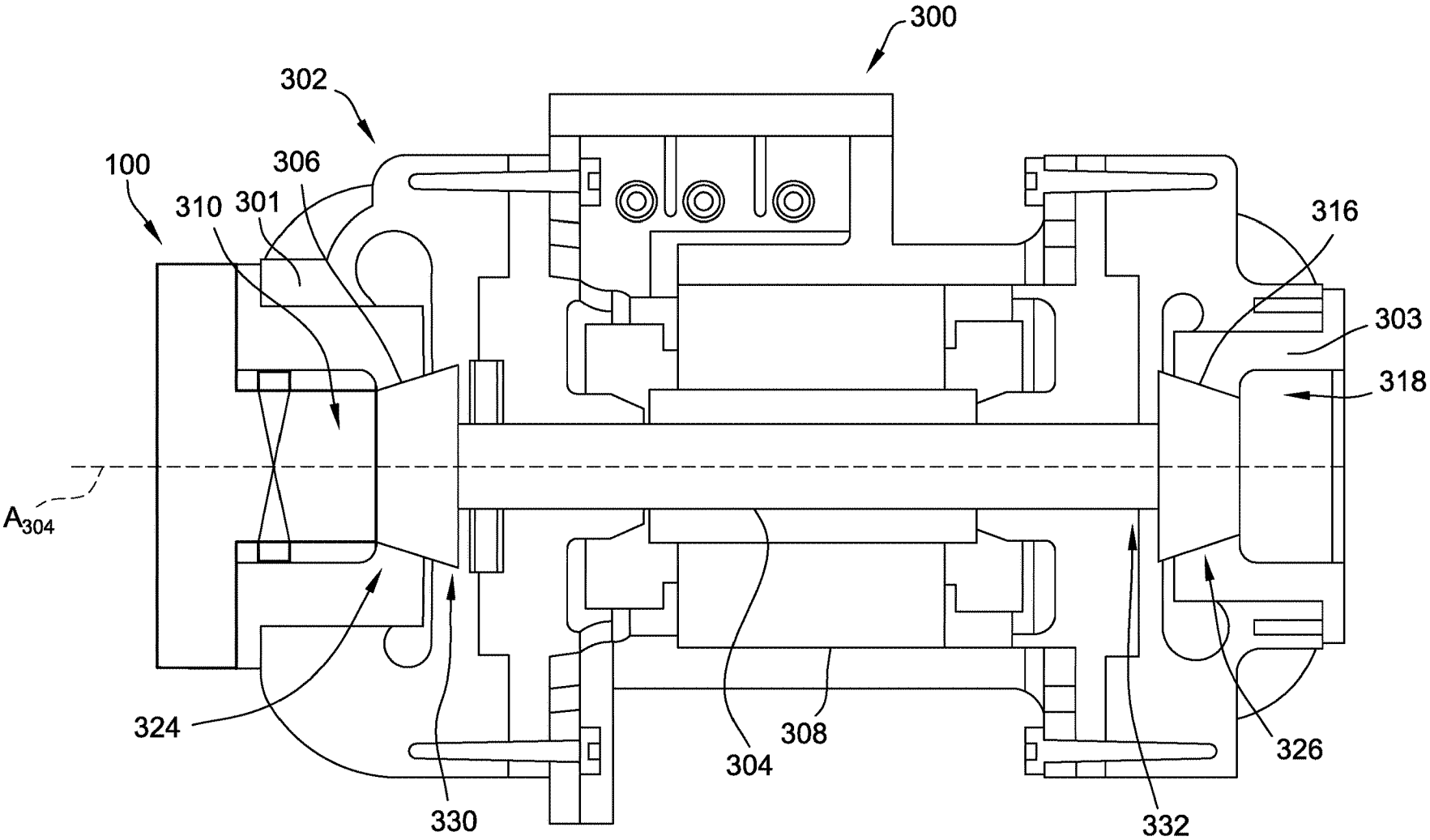
FIG. 20 is a cross-sectional view of the compressor of FIG. 19 taken along line 2-2.

FIGS. 19 and 20 are perspective and sectional views, respectively, of a compressor 300 suitable for use with the inlet guide 100 described herein. The compressor 300 is illustrated in the form of a two-stage centrifugal compressor. The compressor 300 generally includes an outer compressor housing 302 forming at least one sealed cavity within which each stage of refrigerant compression is accomplished. The compressor 300 includes a first refrigerant inlet 310 to introduce refrigerant vapor into the first compression stage, a first refrigerant exit 314, a refrigerant transfer conduit 312 to transfer compressed refrigerant from the first compression stage to the second compression stage, a second refrigerant inlet 318 to introduce refrigerant vapor into the second compression stage, and a second refrigerant exit (not shown in FIG. 20). The inlet guide 100 may be arranged in proximity to the first refrigerant inlet 310. For example, the outlet 132 to the fluid flow passageway P may be arranged in alignment with the first refrigerant inlet 310. Refrigerant transfer conduit 312 is operatively connected at opposite ends to the first refrigerant exit 314 and the second refrigerant inlet 318, respectively. The second refrigerant exit delivers compressed refrigerant from the second compression stage to a cooling system in which compressor 300 is incorporated. The refrigerant transfer conduit 312 may further include a refrigerant bleed (not shown in FIG. 20) to add or remove refrigerant as needed at the compressor 300.

Referring to FIG. 20, the outer compressor housing 302 encloses a first compression stage 324 and a second compression stage 326 at opposite ends of the compressor 300. The first compression stage 324 includes a first stage impeller 306 configured to impart kinetic energy to incoming refrigerant gas entering via the first refrigerant inlet 310. The kinetic energy imparted to the refrigerant by the first stage impeller 306 is converted to increased refrigerant pressure (i.e., compression) as the refrigerant velocity is slowed upon transfer to a diffuser formed between a first stage inlet ring 301 and a portion of the outer compressor housing 302. Similarly, the second compression stage 326 includes a second stage impeller 316 configured to add kinetic energy to refrigerant transferred from the first compression stage 324 entering via the second refrigerant inlet 318. The kinetic energy imparted to the refrigerant by the second stage impeller 316 is converted to increased refrigerant pressure (i.e., compression) as the refrigerant velocity is slowed upon transfer to a diffuser formed between a second stage inlet ring 303 and a second portion of outer compressor housing 302. Compressed refrigerant exits the second compression stage 326 via the second refrigerant exit (not shown in FIG. 20).

The first stage impeller 306 and second stage impeller 316 are connected at opposite ends of a driveshaft 304 that rotates about a driveshaft axis $A_{304}$. The driveshaft extends from a driveshaft first end 330 to a driveshaft second end 332 and is axisymmetric about the driveshaft axis $A_{304}$. Additionally, the driveshaft axis $A_{304}$ extends through a center of gravity of the driveshaft 304. The driveshaft 304 is operatively connected to a motor 308 positioned between the first stage impeller 306 and second stage impeller 316, such that the motor 308 rotates the driveshaft 304 about the driveshaft axis $A_{304}$. The first stage impeller 306 and the second stage impeller 316 are both connected to the driveshaft 304 such that the first stage impeller 306 and second stage impeller 316 are rotated at a rotation speed selected to compress the refrigerant to a pre-selected pressure exiting the second refrigerant exit. Any suitable motor may be incorporated into the compressor 300 including, but not limited to, an electrical motor.

Embodiments of the inlet guide vane apparatus described herein require simple assembly of a few number of components. Embodiments of the inlet guide vane apparatus, described above, include a first and second housing portion, a ring gear and bearing, and a plurality of guide vanes. In the illustrated embodiments, the vane gear of the inlet guide vane and the ring gear are both arranged in an area exterior to the vane housing. Accordingly, these components are accessible to an operator to perform and inspection and/or a repair operation. Specifically, the operator does not need to disassemble the inlet guide vane apparatus to inspect and/or replace the gears of the guide vanes. In one illustrated embodiment, the vane gear is selectively connected to the stem of the guide vane. Accordingly, the vane gear may be removed and replaced, without requiring the operator to disassemble the housing minimizing exposure of bearing surfaces to contaminants. Embodiments of the bearing may be a non-lubricating bearing or is a self-lubricating bearing. As such, the bearing does not require application of lubricants for operation. Embodiments described herein include a relatively small number of components, e.g., a two part "split-housing" that allows the operator to quickly (e.g., within 10 minutes) disassemble and/or reassemble the inlet guide vane apparatus. Furthermore, an operator may only need to use a single tool to disassemble and/or reassemble the inlet guide vane.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Additionally, elements and components described herein may be further divided into additional components or joined together to form fewer components for performing the same functions. Accordingly, the foregoing description and attached drawings are by way of example only and are not intended to be limiting.

What is claimed is:

1. An inlet guide vane apparatus, the apparatus comprising:

a housing assembly defining a fluid flow passageway, the housing assembly comprising:

a first housing portion; and a second housing portion connected to and positioned axially upstream of the first housing portion, wherein the first and second housing portions cooperatively define a plurality of guide vane openings extending radially through the housing assembly and into the fluid flow passageway;

a ring gear rotatable relative to the housing assembly and restricted from axial translation in a first direction relative to the housing assembly; and a plurality of guide vanes connected to the housing assembly, each guide vane comprising:

a stem extending from a first end to a second end, wherein at least a portion of the stem is disposed within one of the guide vane openings;

a vane gear disposed at the first end of the stem and operably connected to the ring gear, wherein the ring gear and the vane gear are accessible from an exterior of the housing assembly; and a vane disposed at the second end of the stem and within the fluid flow passageway of the housing assembly, wherein each of the guide vanes is rotatable relative to the housing assembly such that an orientation of the vane within the fluid flow passageway is selectively adjustable, wherein connection of the first housing portion to the second housing portion operably connects the vane gear of each guide vane to the ring gear.

2. The inlet guide vane apparatus of claim 1, wherein the first housing portion defines a plurality of first channels and the second housing portion defines a plurality of second channels, wherein each of the first channels is aligned with one of the second channels such that the first and second channels cooperatively define the plurality of guide vane openings.

3. The inlet guide vane apparatus of claim 1 further comprising a bearing, wherein the ring gear is rotatably connected to the housing assembly by the bearing.

4. The inlet guide vane apparatus of claim 3, wherein the bearing is a self-lubricating bearing.

5. The inlet guide vane apparatus of claim 1, wherein the plurality of guide vanes includes a drive guide vane and a plurality of follower guide vanes.

6. The inlet guide vane apparatus of claim 5, wherein the drive guide vane is operably connected to a motor operable to rotate the drive guide vane, wherein rotation of the drive guide vane drives rotation of the ring gear and rotation of the ring gear imparts rotation to the plurality of follower guide vanes.

7. The inlet guide vane apparatus of claim 1, wherein each guide vane includes a stop extending radially outward from the stem, and wherein at least one of the first housing portion and the second housing portion defines a plurality of slots, each slot extending from a first stop surface to a second stop surface and being sized and shaped to receive one of the stops therein.

8. The inlet guide vane apparatus of claim 6, wherein the motor is a stepper motor, and wherein contact between the stop and at least one of the first and second stop surfaces stops rotation of the plurality of guide vanes and stops the motor.

9. The inlet guide vane apparatus of claim 1, wherein the vane gear of each guide vane is removably connected to the guide vane.

10. A compressor comprising:

a compressor housing including an inlet;

a driveshaft rotatably supported within the compressor housing;

an impeller connected to the driveshaft and operable to impart kinetic energy to incoming refrigerant gas upon rotation of the driveshaft;

an inlet guide vane apparatus connected to the compressor inlet, the inlet guide vane apparatus comprising:

a housing assembly defining a fluid flow passageway, the housing assembly comprising:

a first housing portion; and a second housing portion connected to and positioned axially upstream of the first housing portion, wherein the first and second housing portions cooperatively define a plurality of guide vane openings extending radially through the housing assembly and into the fluid flow passageway;

a ring gear rotatable relative to the housing assembly and restricted from axial translation in a first direction relative to the housing assembly; and a plurality of guide vanes connected to the housing assembly, each guide vane comprising:

a vane gear disposed at the first end of the stem and operably connected to the ring gear, wherein the ring gear and the vane gear are accessible from an exterior of the housing assembly; and a vane disposed at the second end of the stem and within the fluid flow passageway of the housing assembly, wherein each of the guide vanes is rotatable relative to the housing assembly such that an orientation of the vane within the fluid flow passageway is selectively adjustable, wherein connection of the first housing portion to the second housing portion operably connects the vane gear of each guide vane to the ring gear.

11. The compressor of claim 10, wherein the first housing portion defines a plurality of first channels and the second housing portion defines a plurality of second channels, wherein each of the first channels is aligned with one of the second channels such that the first and second channels cooperatively form the plurality of guide vane openings.

12. The compressor of claim 10, further comprising a bearing, wherein the ring gear is rotatably connected to the housing assembly by the bearing.

13. The compressor of claim 12, wherein the bearing is a self-lubricating bearing.

14. The compressor of claim 10, wherein the plurality of guide vanes includes a drive guide vane and a plurality of follower guide vanes.

15. The compressor of claim 14, wherein the drive guide vane is operably connected to a motor operable to rotate the drive guide vane, wherein rotation of the drive guide vane drives rotation of the ring gear and rotation of the ring gear imparts rotation to the plurality of follower guide vanes.

16. The compressor of claim 10, wherein each guide vane includes a stop, and wherein at least one of the first housing portion and the second housing portion defines a plurality of slots, each slot extending from a first stop surface to a second stop surface and being sized and shaped to receive one of the stops therein.

17. A method of assembling an inlet guide vane apparatus including a housing assembly and a plurality of guide vanes, wherein the housing assembly includes a first housing portion and a second housing portion, and wherein each guide vane includes a stem extending from a first end to a second end, a first vane gear disposed at the first end of the stem, and a vane disposed at the second end of the stem, the method comprising:

rotatably connecting a ring gear to the first housing portion;

connecting the first housing portion to the second housing portion such that the second housing portion is positioned axially upstream of the first housing portion, and such that the first and second housing portions cooperatively define a plurality of guide vane openings extending radially through the housing assembly; and positioning the plurality of guide vanes relative to the second housing portion such that, when the first housing portion is connected to the second housing portion, at least a portion of the stem of each guide vane is disposed within one of the guide vane openings, wherein the ring gear and the vane gear are accessible to an operator from an exterior of the housing assembly, wherein connecting the first housing portion to the second housing portion operably connects the first vane gear of each guide vane to the ring gear.

18. The method of claim 17, wherein the first vane gear of each guide vane is removably connected to the stem, wherein the method further comprises:

removing the first vane gear from the stem of one of the guide vanes; and connecting a second vane gear to the stem of the one guide vane, without disconnecting the first housing portion from the second housing portion.

* * * * *